US007471261B2

(12) United States Patent
Goto et al.

(10) Patent No.: US 7,471,261 B2
(45) Date of Patent: Dec. 30, 2008

(54) DISPLAY DEVICE

(75) Inventors: Mitsuru Goto, Chiba (JP); Nobuhiko Hosotani, Mobara (JP); Toshio Miyazawa, Chiba (JP); Hiroyuki Takahashi, Funabashi (JP); Hitoshi Komeno, Mobara (JP)

(73) Assignee: Hitachi Device Engineering Co., Ltd.

( * ) Notice: Subject to any disclaimer, the term of this patent is extended or adjusted under 35 U.S.C. 154(b) by 527 days.

(21) Appl. No.: 10/937,358

(22) Filed: Sep. 10, 2004

(65) Prior Publication Data

US 2005/0052340 A1 Mar. 10, 2005

(30) Foreign Application Priority Data

Sep. 10, 2003 (JP) ..... 2003-317978

(51) Int. Cl.
*G09G 5/00* (2006.01)

(52) U.S. Cl. ..... 345/1.1; 345/39; 345/55; 345/204

(58) Field of Classification Search ..... 345/1.1, 345/55, 39, 204
See application file for complete search history.

(56) References Cited

U.S. PATENT DOCUMENTS 6,864,942 B2 * 3/2005 Hsieh ..... 349/151
2002/0060655 A1 5/2002 Moon
2004/0075628 A1 * 4/2004 Chien et al. ..... 345/82
2005/0219178 A1 * 10/2005 Nah et al. ..... 345/88

FOREIGN PATENT DOCUMENTS

JP 2001-067049 * 3/2001
JP 2002-196733 7/2002

* cited by examiner

*Primary Examiner*—Richard Hjerpe
*Assistant Examiner*—Leonid Shapiro
(74) *Attorney, Agent, or Firm*—Antonelli, Terry, Stout & Kraus, LLP.

(57) ABSTRACT

An integral-type liquid crystal display module has a first display panel and a second display panel, and it can use a display panel of high resolution as the second display panel. The display device includes a first display panel, a second display panel, and a first flexible printed circuit board which connects the first display panel and the second display panel. The first display panel includes a display drive unit. Video lines of the second display panel are connected with the display drive unit through connection lines for video lines of the first flexible printed circuit board. Further, the second display panel includes a scanning line drive unit which supplies drive voltages to scanning lines of the second display panel.

9 Claims, 26 Drawing Sheets

| | | | | | | | | | | | | | | | | | | |
|---|---|---|---|---|---|---|---|---|---|---|---|---|---|---|---|---|---|---|
| SUB | 18 | 17 | 16 | 15 | 14 | 13 | 12 | 11 | 10 | 9 | 8 | 7 | 6 | 5 | 4 | 3 | 2 | 1 |
| | 36 | 35 | 34 | 33 | 32 | 31 | 30 | 29 | 28 | 27 | 26 | 25 | 24 | 23 | 22 | 21 | 20 | 19 |
| | 54 | 53 | 52 | 51 | 50 | 49 | 48 | 47 | 46 | 45 | 44 | 43 | 42 | 41 | 40 | 39 | 38 | 37 |
| | B | A | B | A | B | A | B | A | B | A | B | A | B | A | B | A | B | A |

| | | | | | | | | | | |
|---|---|---|---|---|---|---|---|---|---|---|
| A | 17 | 15 | 13 | 11 | 9 | 7 | 5 | 3 | 1 | WL1 |
| B | 18 | 16 | 14 | 12 | 10 | 8 | 6 | 4 | 2 | WL2 |
| RAM A | 35 | 33 | 31 | 29 | 27 | 25 | 23 | 21 | 19 | WL3 |
| B | 36 | 34 | 32 | 30 | 28 | 26 | 24 | 22 | 20 | WL4 |
| A | 53 | 51 | 49 | 47 | 45 | 43 | 41 | 39 | 37 | WL5 |
| B | 54 | 52 | 50 | 48 | 46 | 44 | 42 | 40 | 38 | WL6 |

DISPLAY DEVICE

BACKGROUND OF THE INVENTION

The present invention relates to a display device having two display panels, and, more particularly, to a display device which is mounted on a portable device, such as a mobile phone or the like.

A TFT (thin film transistor) type liquid crystal display module which includes a miniaturized liquid crystal display panel having approximately 100×150×3 pieces of sub pixels in a color display or an EL display device which includes an organic EL element has been popularly used as a display part in portable equipment, such as a mobile phone.

Further, recently, a foldable mobile phone which includes a main display part and a sub display part also has been available.

As a liquid crystal display module for the mobile phone provided with a main display part and a sub display part, there in an integral-type liquid crystal display module having a first liquid crystal display panel which corresponds to the main display part and a second liquid crystal display panel which corresponds to the sub display part (see Japanese Unexamined Patent Publication 2001-282145 (patent literature 1), Japanese Unexamined Patent Publication 2002-220606 (patent literature 2)).

The integral-type liquid crystal display module described in the above-mentioned respective patent publications is configured such that the first liquid crystal display panel and the second liquid crystal display panel are connected using connection lines on a flexible printed circuit board; and, at the same time, the first and the second liquid crystal display panels are driven by one liquid crystal drive circuit.

Due to such a constitution, it is possible to reduce the number of mounting parts; and, hence, the manufacturing cost can be reduced, and, at the same time, the installation space can be reduced.

SUMMARY OF THE INVENTION

Recently, with regard to the above-mentioned foldable mobile telephone, there has been a demand for a large-sizing of the screen of the sub display part; and, along with such a demand, the second liquid crystal display panel is required to provide a higher resolution. Here, when the number of sub pixels in the second liquid crystal display panel is increased, in the above-mentioned integral-type liquid crystal display module, the number of connection lines on the flexible printed circuit board, which connects the first liquid crystal display panel and the second liquid crystal display panel, is increased.

However, with respect to the flexible printed circuit board, a restriction is imposed on the terminal pitches in manufacturing; and, hence, it is difficult to largely increase the number of connection lines, whereby in the above-mentioned integral-type liquid crystal display module, a display panel having the high resolution can not be used as the second liquid crystal display panel.

The present invention has been made to solve the above-mentioned drawbacks, and it is an object of the present invention to provide an integral-type liquid crystal display module having a first display panel and a second display panel, in which a display panel having a high resolution can be used as the second display panel.

The above-mentioned object, other objects and novel features of the present invention will become apparent from the description provided in this specification and the attached drawings.

A summary of representative features and aspects of the invention disclosed in this specification is as follows.

To achieve the above-mentioned object, the present invention is directed to a display device which includes a first display panel, a second display panel, and a flexible printed circuit board which connects the first display panel and the second display panel, wherein the first display panel includes display drive means. Video lines of the second display panel are connected to the display drive means through connection lines of the flexible printed circuit board, and the second display panel is provided with scanning drive means which supplies drive voltages to scanning lines of the second display panel.

Further, the present invention is characterized in that, assuming that the total number of video lines in the second display panel is N and the total number of connection lines for video lines of the flexible printed circuit board is n (N>n), the second display panel includes switching means which connects every n video lines out of N video lines to the connection lines for n video lines on the flexible printed circuit board during one scanning period.

The advantageous effects obtained by representative aspects of the invention disclosed in this specification are as follows.

According to the present invention, in an integral-type liquid crystal display module having a first display panel and a second display panel, it is possible to use a display panel having the high resolution as the second display panel.

DESCRIPTION OF THE PREFERRED EMBODIMENTS

Preferred embodiments of the present invention will be explained in detail in conjunction with the attached drawings hereinafter.

Here, in all of the drawings, parts having identical functions are indicated by the same symbols, and a repeated explanation thereof is omitted.

Embodiment 1

Figure 1A:
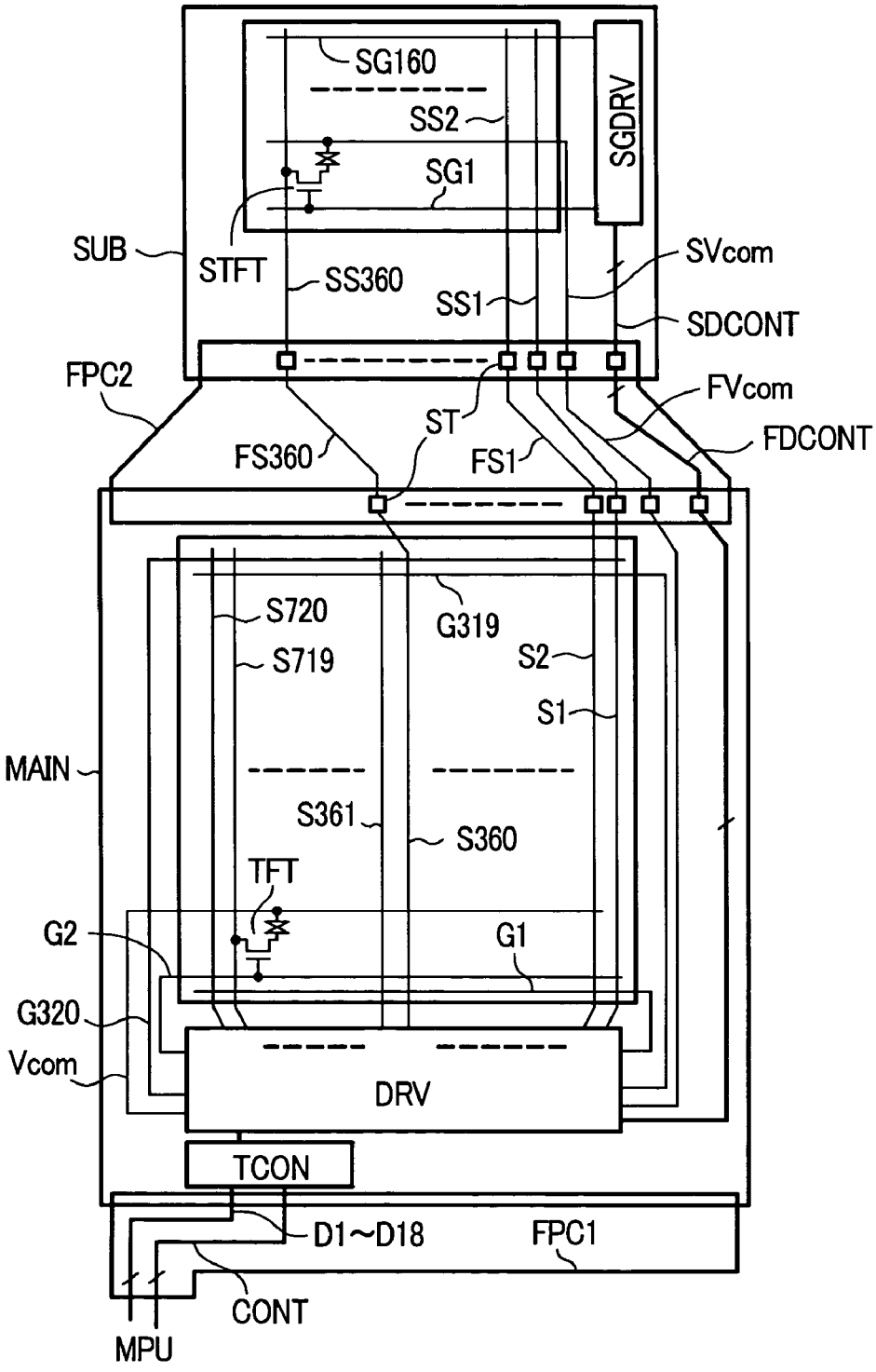
FIG. 1A is a diagram showing the constitution of a liquid crystal display module representing an embodiment 1 of the present invention.

FIG. 1A is a diagram showing the constitution of a liquid crystal display module representing an embodiment 1 of the present invention.

The liquid crystal display module of this embodiment is an integral-type liquid crystal display module having a first liquid crystal display panel and a second liquid crystal display panel.

In FIG. 1A, symbol MAIN indicates the first liquid crystal display panel, which constitutes a main display part when a foldable mobile phone is used in an opened state, while symbol SUB indicates a second liquid crystal display panel, which constitutes a sub display part when the foldable mobile phone is used in a closed state.

In this embodiment, the number of sub pixels of the first liquid crystal display panel (MAIN) is 240×3(R·G·B)×320, while the number of sub pixels of the second liquid crystal display panel (SUB) is 120×3×160.

Each one of the first liquid crystal display panel (MAIN) and the second liquid crystal display panel (SUB) is constituted such that a TFT substrate, on which pixel electrodes, thin film transistors and the like are formed, and a filter substrate, on which counter electrodes, color filters and the like are formed, are overlapped relative to each other with a given gap therebetween. Both substrates are laminated to each other using a seal material, which is provided in a frame shape in the vicinity of peripheral portions of both substrates; liquid crystal is filled into the space inside of the seal material defined between both substrates through a liquid crystal filling port formed in a portion of the seal material and is sealed therein; and polarizers are laminated to the outsides of both substrates.

Here, since the present invention is irrelevant to the inner structure of the liquid crystal display panel, a detailed explanation of the inner structure of the liquid crystal display panel is omitted. Further, the present invention is applicable to a liquid crystal display panel having any structure.

In this embodiment, on a glass substrate of the first liquid crystal display panel (the glass substrate constituting a portion of the TFT substrate of the first liquid crystal display panel), a liquid crystal driver (DRV), which constitutes display drive means of the present invention, and a TFT controller (TCON) are mounted. Further, on a glass substrate of the second liquid crystal display panel, a sub scanning line drive circuit (SGDRV), which constitutes scanning line drive means of the present invention, is mounted.

The liquid crystal driver (DRV) includes a main video line drive circuit, which drives video lines (S1 to S720) of the first liquid crystal display panel (MAIN), a sub video line drive circuit which drives video lines (SS1 to SS360) of the second liquid crystal display panel (SUB), a main scanning line drive circuit which drives scanning lines (G1 to G320) of the first liquid crystal display panel (MAIN), a main Vcom drive circuit which drives common lines (Vcom) of the first liquid crystal display panel (MAIN), a sub Vcom drive circuit which drives common lines (SVcom) of the second liquid crystal display panel (SUB), a control circuit for a sub scanning line drive circuit which controls the sub scanning line drive circuit (SGDRV), a memory which stores display data, a memory control circuit and the like.

To the TFT controller (TCON), display data (D1 to D18) and display control signals (CONT) are inputted from a micro processing unit (hereinafter referred to as MPU) from the outside through the flexible printed circuit board FPC1.

Here, in FIG. 1A, the case in which the liquid crystal driver (DRV) and the TFT controller (TCON) are constituted of respective individual semiconductor chips is illustrated, however, the liquid crystal driver (DRV) and the TFT controller (TCON) may be constituted of one semiconductor chip. Further, the sub scanning line drive circuit (SGDRV) is also constituted of a semiconductor chip.

As shown in FIG. 1A, the first liquid crystal display panel (MAIN) and the second liquid crystal display panel (SUB) are connected to the flexible printed circuit board (FPC2) through terminals (ST). On the flexible printed circuit board (FPC2), connection lines for video lines (FS1 to FS360), connection lines for control signals (FDCONT) and connection lines for common lines (FVcom) are formed. That is, the video lines (SS1 to SS360) of the second liquid crystal display panel (SUB) are connected to the liquid crystal driver (DRV) through the connection lines for video lines (FS1 to FS360) of the flexible printed circuit board (FPC2) and the video lines (S1 to S360) of the first liquid crystal display panel (MAIN).

Further, to the sub scanning line drive circuit (SGDRV), sub scanning line drive circuit control signals (SDCONT) are inputted through the lines of the first liquid crystal display panel (MAIN), the connection lines for control signals (FDCONT) of the flexible printed circuit board (FPC2) and the lines of the second liquid crystal display panel (SUB) from the liquid crystal driver (DRV). Here, the sub scanning line drive circuit control signals (SDCONT) include a power source voltage of the sub scanning line drive circuit (SGDRV) and control signals.

Further, the common lines (SVcom) of the second liquid crystal display panel (SUB) are connected to the liquid crystal driver (DRV) through the connection lines for common lines (FVcom) of the flexible printed circuit board (FPC2) and the lines of the first liquid crystal display panel (MAIN).

Figure 1B:
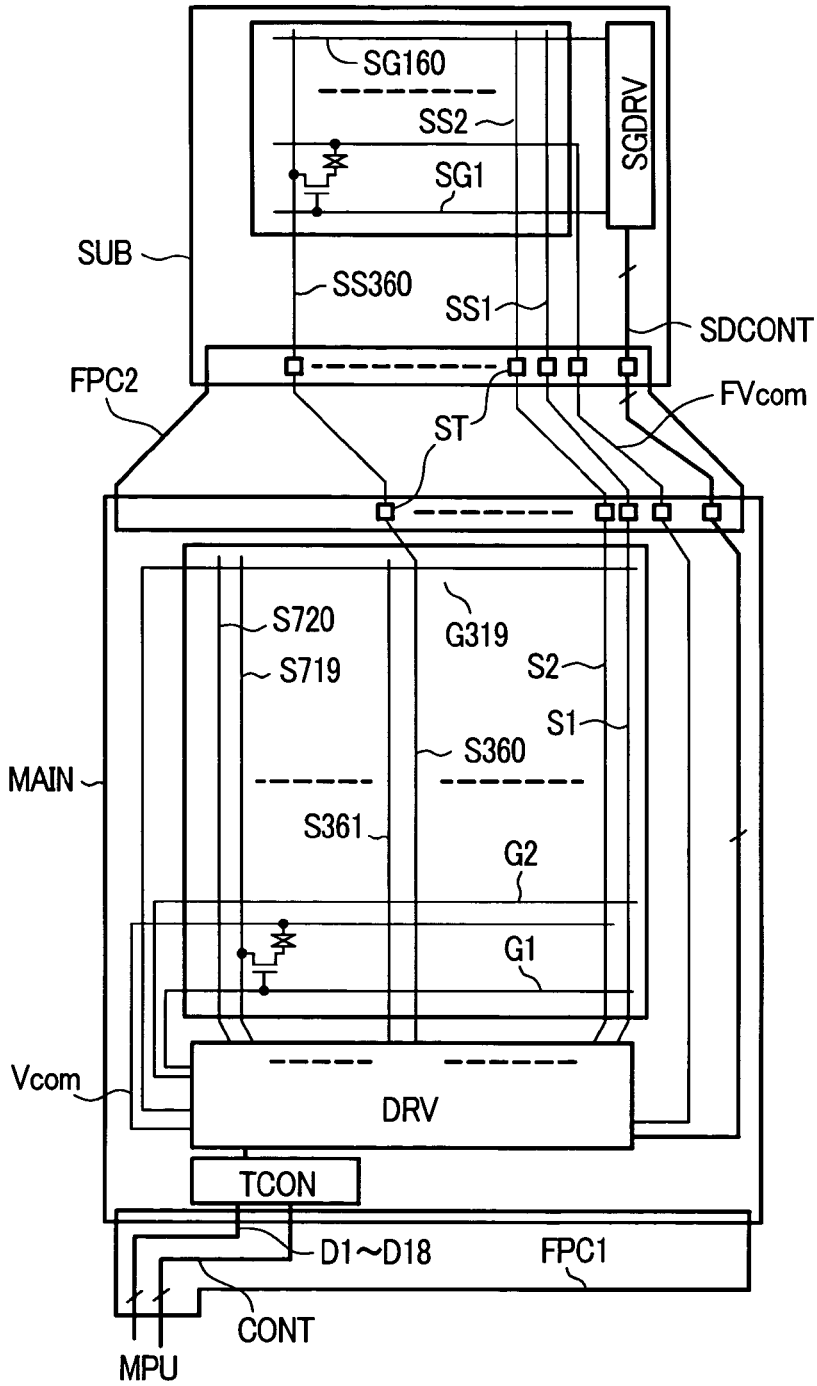
FIG. 1B is a diagram showing a modification of the liquid crystal display module of the embodiment 1 of the present invention.

FIG. 1B is a view showing a modification of this first embodiment. The modification shown in FIG. 1B is characterized in that the scanning lines of the first liquid crystal display panel (MAIN) are arranged on one side of the display region (AR).

Due to such a constitution, according to this embodiment, the sub scanning line drive circuit (SGDRV) is formed on the second liquid crystal display panel (SUB), and, hence, it is possible to largely reduce the number of connection lines on the flexible printed circuit board compared to a case in which the video lines and the scanning lines of the second liquid crystal display panel (SUB) are connected to the liquid crystal driver (DRV) of the first liquid crystal display panel (MAIN) through the connection lines of the flexible printed circuit board (FPC2), as in the case of the conventional integral-type liquid crystal display module.

For example, in the conventional example, as the connection lines of the flexible printed circuit board (FPC2), 520 connection lines (360 connection lines for video lines+160 connection lines for scanning lines) become necessary. On the other hand, when the number of sub pixels of the second liquid crystal display panel (SUB) is 120×3×160, as in the case of this embodiment, it is possible to reduce the number of connection lines to 370 lines ((360 connection lines for video lines+10 connection lines for a control signal and the like).

In this manner, according to this embodiment, it is possible to use a display panel having a high resolution as the second liquid crystal display panel (SUB) without increasing the number of connection lines of the flexible printed circuit board (FPC2). Here, with respect to the liquid crystal display module of this embodiment, the display method for displaying images on the first liquid crystal display panel (MAIN) and the second liquid crystal display panel (SUB) will be explained later.

Embodiment 2

Figure 2:
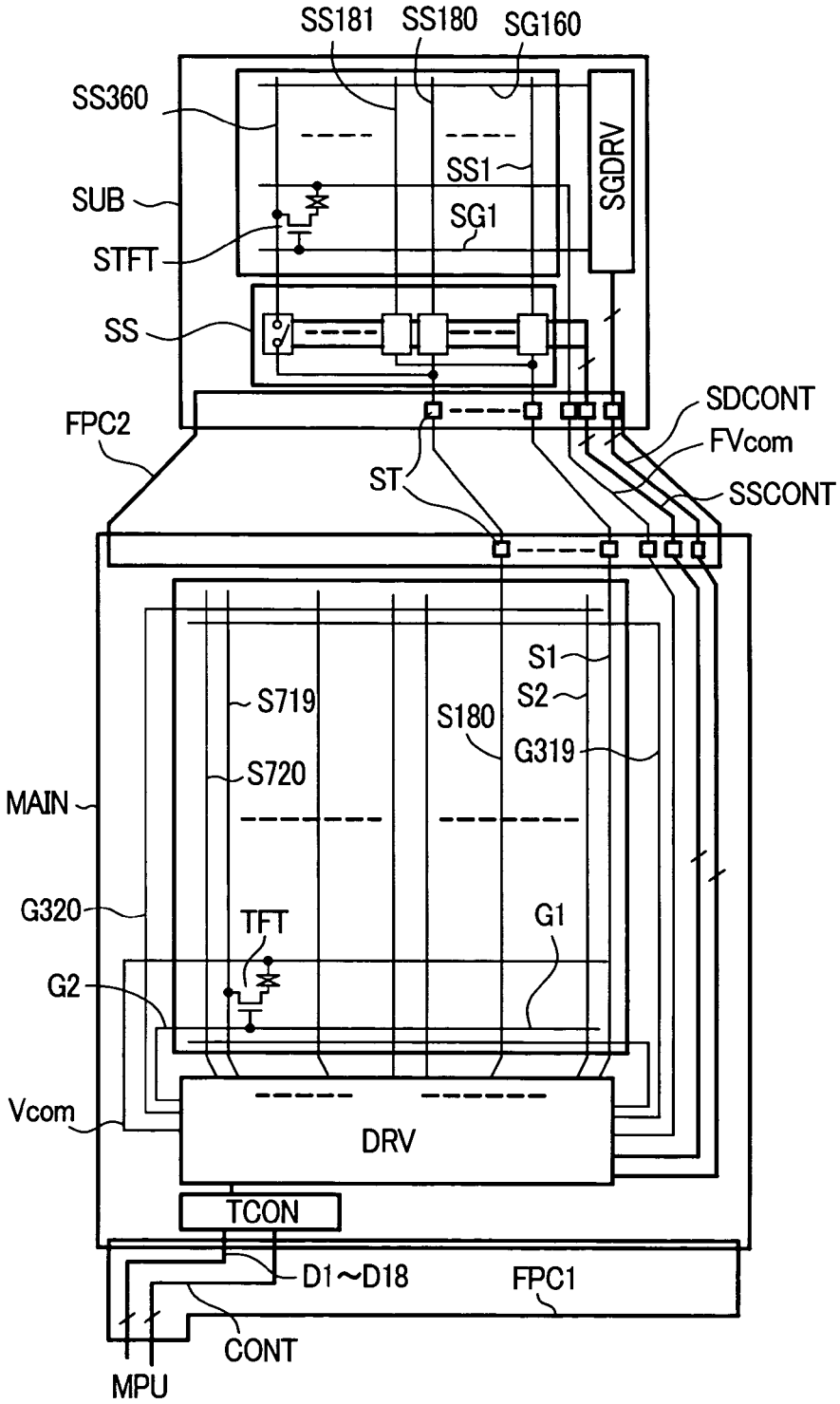
FIG. 2 is a diagram showing the constitution of a liquid crystal display module representing an embodiment 2 of the present invention.

FIG. 2 is a diagram showing the constitution of the liquid crystal display module representing an embodiment 2 of the present invention. The liquid crystal display module of this embodiment differs from the liquid crystal display module of the previous embodiment with respect to the fact that a video line selection circuit (SS) is formed on the second liquid crystal display panel (SUB).

Hereinafter, the liquid crystal display module of this embodiment will be explained hereinafter by focusing on the points which make this embodiment different from the previous embodiment.

In this embodiment, 360 video lines of the second liquid crystal display panel (SUB) are divided into halves, each of which consists of 180 video lines. In conformity with such division of video lines, the connection lines for video lines of the flexible printed circuit board (FPC2) are also divided into halves, each of which is constituted of 180 connection lines.

Further, the video line selection circuit (SS) connects 180 video lines of the second liquid crystal display panel (SUB), which is obtained by a two-split division with 180 connection lines for video lines of the flexible printed circuit board (FPC2) alternately by a time-shared processing.

Accordingly, for example, when the number of sub pixels of the second liquid crystal display panel (SUB) is 120×3×160, as in the case of this embodiment, assuming that the signal lines for the sub video line selection circuit control signal for controlling the video line selection circuit (SS) are two, according to this embodiment, the connection lines of the video flexible printed circuit board (FPC2) can be reduced to 192 lines (180 lines for video signal lines+12 lines for control signals).

In this manner, according to this embodiment, it is possible to further reduce the number of connection lines of the flexible printed circuit board (FPC2).

The liquid crystal driver (DRV) of the liquid crystal display module shown in FIG. 1 or 2 has a memory (RAM) in which the display data (D1 to D18) transmitted from the MPU at the body side is stored.

Figure 3:
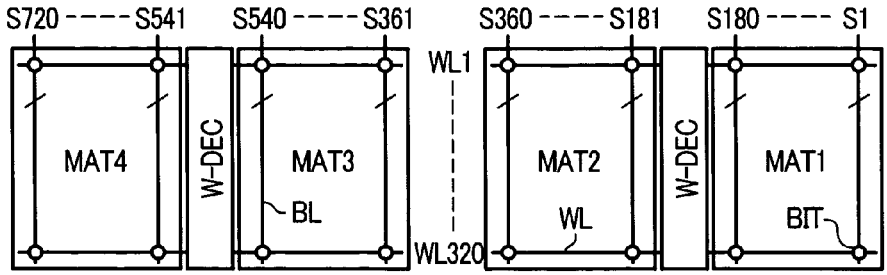
FIG. 3 is a diagram showing one example of the arrangement of a memory (RAM) of the liquid crystal driver (DRV) shown in FIG. 1 and FIG. 2.

FIG. 3 shows one example of the arrangement of the memory (RAM) of the liquid crystal driver (DRV) shown in FIG. 1 and FIG. 2. Here, "O" in FIG. 3 indicates a memory element for one sub pixel in the liquid crystal display panel.

As shown in FIG. 3, the memory (RAM) corresponds to the arrangement of the screen display, wherein bit lines (BL) which correspond to the sequence of video lines in the lateral direction and word lines (WL) which correspond to the sequence of the scanning lines in the longitudinal direction are provided in the memory (RAM).

In general, the memory (RAM) is suitably divided to reduce the drive loads. In FIG. 3, the word lines (WL) are divided into four memory mats (MAT1 to MAT4). Accordingly, each memory mat corresponds to 180 video lines of the first liquid crystal display panel (MAIN).

Figure 4:
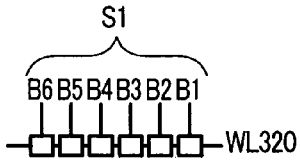
FIG. 4 is a schematic diagram showing the constitution of the memory for one sub pixel shown in FIG. 3.

FIG. 4 is a view showing the constitution of the memory for one sub pixel shown in FIG. 3, wherein FIG. 4 shows a case in which one sub pixel is constituted of 6 bits. That is, FIG. 4 shows that the bit output lines (B1 to B6) of 6 bits correspond to one video line.

Figure 5:
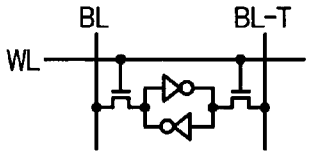
FIG. 5 is a schematic diagram showing the specific circuit constitution of a memory element of each bit shown in FIG. 4.

FIG. 5 is a view showing the specific circuit constitution of the memory element of each bit shown in FIG. 4. As shown in FIG. 5, the memory element of each bit shown in FIG. 4 is configured according to the general SRAM (Static Random Access Memory). Here, in FIG. 5, BL, BL-T constitute complimentary bit lines.

Figure 6:
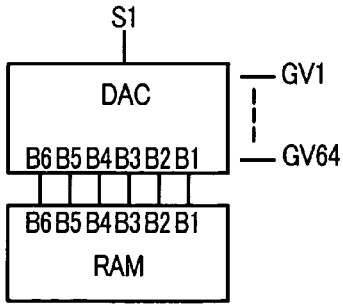
FIG. 6 is a diagram illustrating the manner of generating gray scale voltages applied to video lines of the liquid crystal display panel.

FIG. 6 is a view illustrating the manner of generating gray scale voltages applied to the video lines of the liquid crystal display panel. By selecting the word line (WL) to be displayed by the controller using the word decoder (W-DEC) shown in FIG. 3, display data is outputted from the bit line (BL). Based on this display data, an A/D converting circuit (DAC) selects a gray scale voltage corresponding to the display data, among the gray scale voltages (GV1 to GV64) of 64 gray scales, and outputs the selected gray scale voltage to the video line.

In this embodiment, the liquid crystal driver (DRV) sequentially outputs signals which turn on the thin film transistors (TFT) to the scanning lines during one horizontal scanning time, based on display control signals (vertical synchronizing signal, a display timing signal, a horizontal synchronizing signal) which are inputted from the outside.

Further, the liquid crystal driver (DRV) reads out the display data of sub pixels corresponding to the selected scanning line from the memory, and the gray scale voltage corresponding to the display data is generated by the A/D converting circuit (DAC); and, thereafter, the gray scale voltage is outputted to the video lines.

Accordingly, the gray scale voltages are applied to the liquid crystal at respective pixel portions, and, hence, the orientation directions or the like of the liquid crystal molecules are changed. By making use of the change of the nature of the liquid crystal in response to light, which is caused by the change of the orientation directions of the liquid crystal molecules, images are displayed on the first liquid crystal display panel (MAIN).

In the second liquid crystal display panel (SUB), the sub scanning line drive circuit (SGDRV) sequentially outputs signals which turn on the thin film transistors (STFT) to the scanning lines during one horizontal scanning time, and, hence, images are displayed due to an operation similar to the above-mentioned operation.

Figure 7:
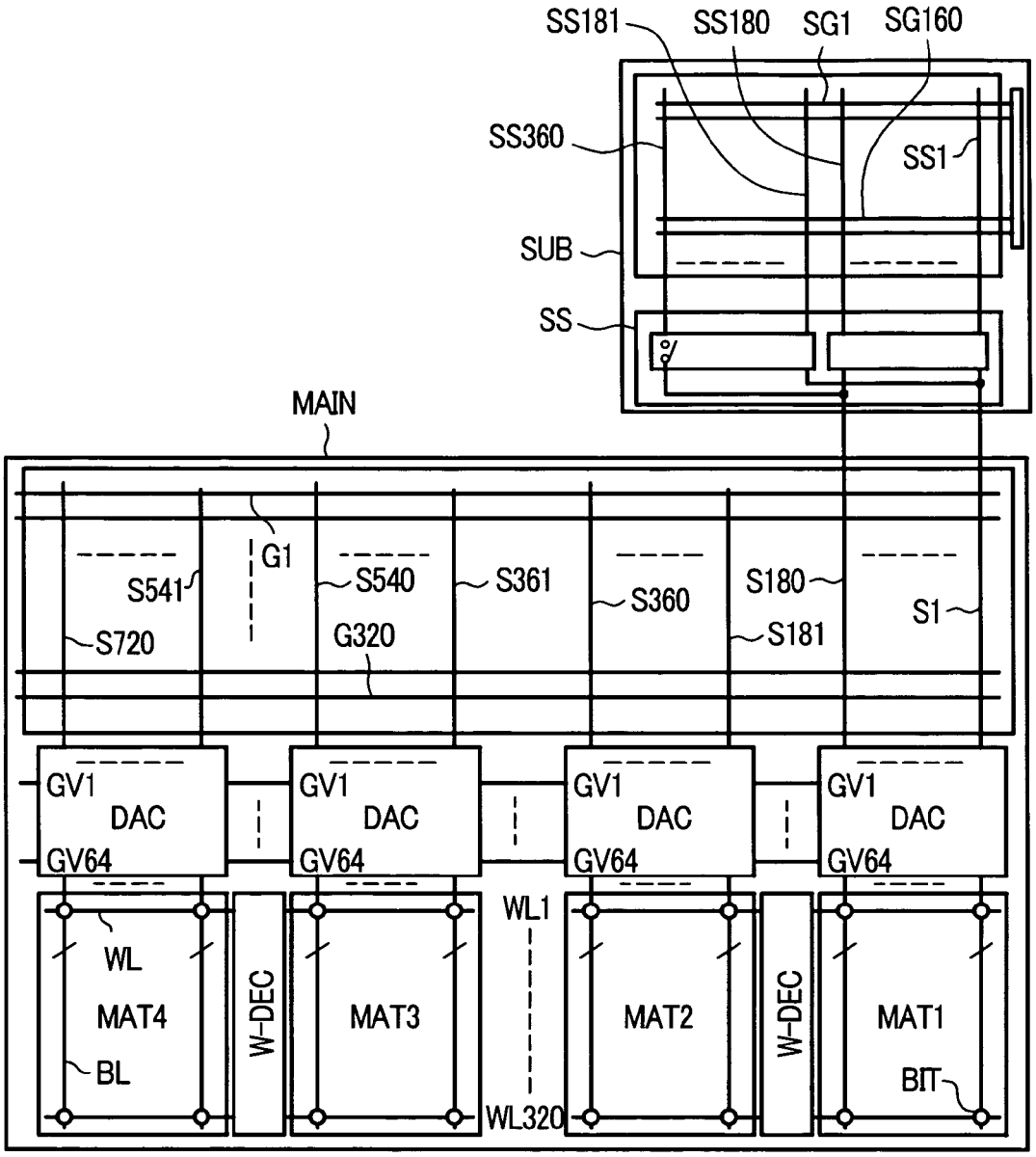
FIG. 7 is a block circuit diagram showing one example of the arrangement of a memory (RAM) for driving a first liquid crystal display panel (MAIN) and a second liquid crystal display panel (SUB) of the embodiment 2 of the present invention.

FIG. 7 is a circuit diagram showing one example of the arrangement of the memory (RAM) for driving the first liquid crystal display panel (MAIN) and the second liquid crystal display panel (SUB) of this embodiment. FIG. 7 is directed in particular to a case in which the memory mat (MAT1) is used by the first liquid crystal display panel (MAIN) and the second liquid crystal display panel (SUB) in common.

At the time of displaying the images on the first liquid crystal display panel (MAIN), the display data corresponding to the first liquid crystal display panel (MAIN) is held in the memory mats (MAT1 to MAT4). At the time of displaying the images on the second liquid crystal display panel (SUB), the display data corresponding to the second liquid crystal display panel (SUB) is held in the memory mat (MAT1).

In FIG. 7, the memory mat (MAT1) corresponds to the number of sub pixels (120×3×160×6=345600 bits) in the second liquid crystal display panel (SUB).

In this embodiment, with respect to the memory mat (MAT1), the sub pixels of (G1 to G160)×(S1 to S180) in the first liquid crystal display panel (MAIN) correspond to the sub pixels of (SG1 to SG160)×(SS1 to SS180) or sub pixels of (SG1 to SG160)×(SS181 to SS360) in the second liquid crystal display panel (SUB). In the same manner, the sub pixels of (G181 to G320)×(S1 to S180) in the first liquid crystal display panel (MAIN) correspond to the sub pixels of (SG1 to SG160)×(SS181 to SS360) or sub pixels of (SG1 to SG160)×(SS1 to SS180) in the second liquid crystal display panel (SUB). This changeover is executed by the video line selection circuit (SS).

In this manner, by using the memory mat (MAT1) in the first liquid crystal display panel (MAIN) and the second liquid crystal display panel (SUB) in common, it is possible to store the display data for the first liquid crystal display panel (MAIN) and the second liquid crystal display panel (SUB) without increasing the memory (RAM), and, hence, the manufacturing cost can be reduced.

Further, with the use of a single controller, it is possible to control the images displayed on the first liquid crystal display panel (MAIN) and the images displayed on the second liquid crystal display panel (SUB).

Further, by arranging the video line selection circuit SS in the second liquid crystal display panel (SUB), it is possible to display the images on the whole screen of the second liquid crystal display panel (SUB) using the output of the D/A converting circuit, which is smaller than the output of the video lines of the second liquid crystal display panel (SUB) in number.

Further, it is possible to set the number of video lines from the first liquid crystal display panel (MAIN) to the second liquid crystal display panel (SUB) to be smaller than the total number of video lines of the second liquid crystal display panel (SUB).

Still further, assuming that the number of sub pixels of the second liquid crystal display panel (SUB) is (k×j), it is possible to produce a display using the memory (RAM) where the memory element for one sub pixel in the liquid crystal display panel is (k/2)×(j×2).

Here, the memory mat which is used by the first liquid crystal display panel (MAIN) and the second liquid crystal display panel (SUB) in common may be any one of MAT1 to MAT4 and may be selected in view of the easiness of leading the lines.

Further, in the memory mat (MAT1), when the memory element for one sub pixel in the liquid crystal display panel is larger than the number of pixels of the second liquid crystal display panel (SUB) (the number of pixels in the second liquid crystal display panel (SUB) being 120×3×80 or the like), the memory element may still have the sufficient storage capacity.

Figure 8:
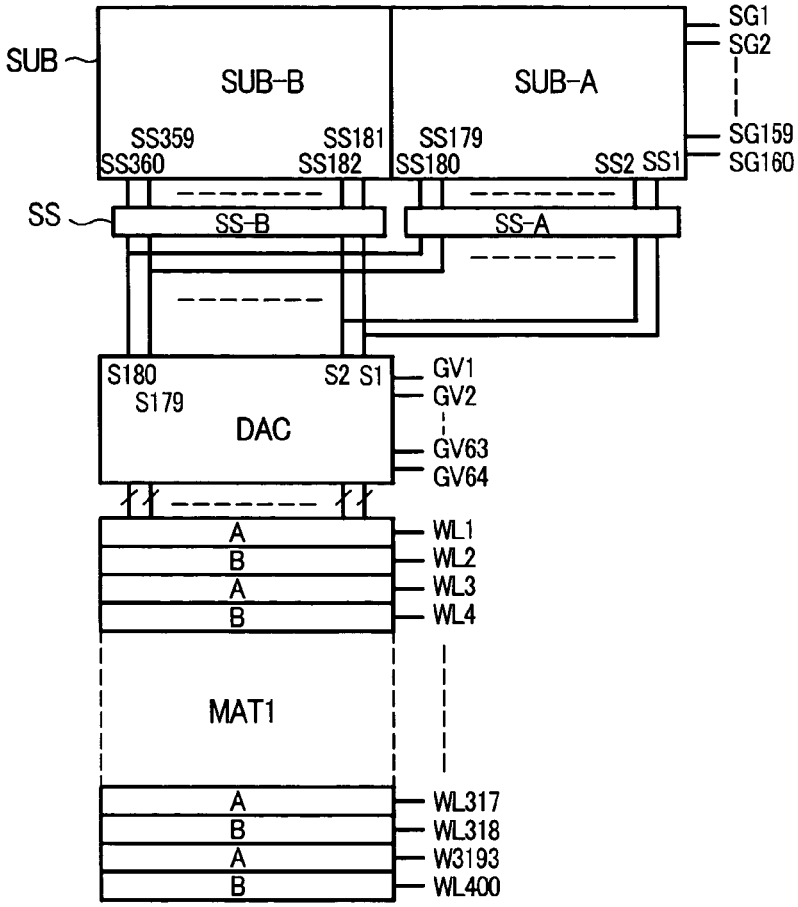
FIG. 8 is a block diagram showing one example in which a memory mat (MAT1) and sub pixels of the second liquid crystal display panel (SUB) are made to correspond to each other in the embodiment 2 of the present invention.

FIG. 8 is a view showing one example in which the memory mat (MAT1) and the sub pixel of the second liquid crystal display panel (SUB) correspond to each other.

In FIG. 8, symbol SUB-A indicates a screen region A on which an image is displayed in the second liquid crystal display panel (SUB) when the video line selection circuit A (SS-A), which constitutes the video line selection circuit (SS), is turned on, while symbol SUB-B indicates a screen region B on which an image is displayed in the second liquid crystal display panel (SUB) when the video line selection circuit B (SS-B), which constitutes the video line selection circuit (SS), is turned on.

Further, in FIG. 8, the display data of the screen region A is stored in the memory elements of the odd-numbered word lines (WL) of the memory mat (MAT1) and the display data of the screen region B is stored in the memory elements of the even-numbered word lines (WL) of the memory mat (MAT1).

In the case shown in FIG. 8, the display data of the first word line (WL1) of the memory mat (MAT1) is read out and the gray scale voltage corresponding to the display data is selected at the D/A converting circuit (DAC). Further, the video line selection circuit A (SS-A) is turned on, the video line selection circuit (SS-B) is turned off, and the first scanning line (SG1) of the second liquid crystal display panel (SUB) is turned on.

Accordingly, the gray scale voltage is written in the pixels on the first scanning line (SG1) of the screen region A of the second liquid crystal display panel (SUB).

Next, the display data of the second word line (WL2) of the memory mat (MAT1) is read out and the gray scale voltage corresponding to the display data is selected at the D/A converting circuit (DAC). Further, the video line selection circuit A (SS-A) is turned off, the video line selection circuit B (SS-B) is turned on, and the first scanning line (SG1) of the second liquid crystal display panel (SUB) is held in an ON state. Accordingly, the gray scale voltage is written in the pixels on the first scanning line (SG1) of the screen region B of the second liquid crystal display panel (SUB).

The above-mentioned operation is executed up to the 160th scanning line (SG160) so as to display an image on the whole screen of the second liquid crystal display panel (SUB).

Figure 9:
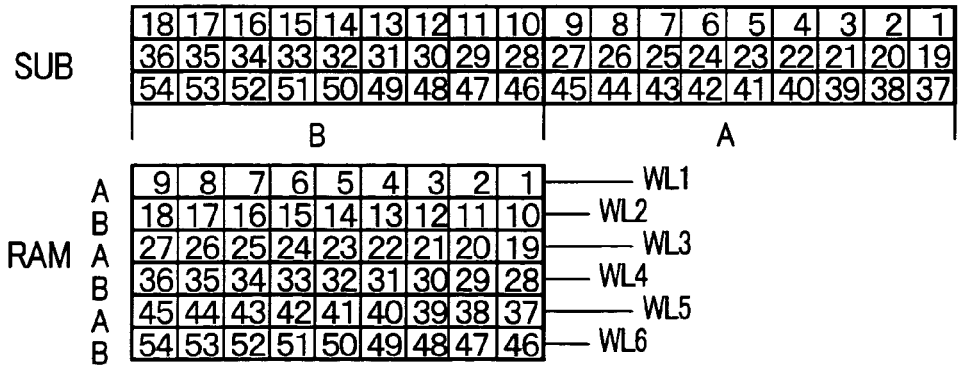
FIG. 9 is a diagram showing the relationship between the display data stored in the memory mat (MAT1) and the sub pixels to which gray scale voltages are applied based on the display data when the number of sub pixels in the second liquid crystal display panel (SUB) is 6×3×3 in the embodiment 2 of the present invention.

FIG. 9 shows the relationship between the display data stored in the memory mat (MAT1) and the sub pixels to which the gray scale voltage is applied based on the display data when the number of sub pixels in the second liquid crystal display panel (SUB) is 6×3×3.

Due to the above-mentioned operations, the gray scale voltages which correspond to the display data of 1 to 9 stored in the memory elements of the word line (WL1) shown in FIG. 9 are written in the pixels corresponding to the video lines (SS1 to SS9) on the display line corresponding to the scanning line (SG1), while the gray scale voltages which correspond to the display data of 28 to 36 stored in the memory elements of the word line (WL2) are written in the pixels corresponding to the video lines (SS10 to SS18) on the display line corresponding to the scanning line (SG1).

In the same manner, in the pixels corresponding to the video lines (SS1 to SS18) on the display line corresponding to the scanning line (SG2), the gray scale voltages which correspond to the display data of 10 to 18 and 37 to 45 stored in the memory elements of the word line (WL3) and the word line (WL4) are written; while, in the pixels corresponding to the video lines (SS1 to SS18) on the display line corresponding to the scanning line (SG3), the gray scale voltages which correspond to the display data of 19 to 27 and 46 to 54 are stored in the memory elements of the word line (WL5) and the word line (WL6) are written.

Here, it is needless to say that by inversely performing the turning on or off of the video line selection circuit A(ss-A) and the video line selection circuit B(ss-B), it is possible to reverse the correspondence between A, B of the memory mat (MAT1) and the screen regions A, B of the second liquid crystal display panel (SUB).

Figure 10:
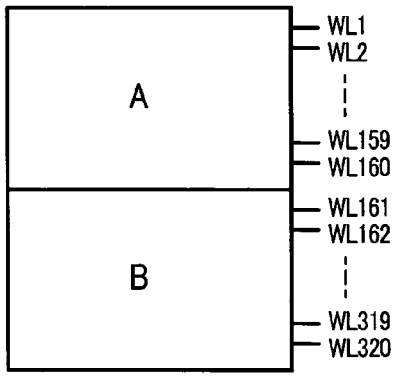
FIG. 10 is a diagram showing another example in which the memory mat (MAT1) and the sub pixels of the second liquid crystal display panel (SUB) are made to correspond to each other in the embodiment 2 of the present invention.

FIG. 10 shows another example of correspondence between the memory mat (MAT1) and the sub pixels of the second liquid crystal display panel (SUB). In FIG. 10, the display data of the screen region A is stored in an upper half of the memory mat (MAT1) (memory elements on 1 to 160th word lines (WL)), while the display data of the screen region B is stored in a lower half of the memory mat (MAT1) (memory elements on 161st to 320th word lines (WL)).

In the case shown in FIG. 10, the display data on the first word line (WL1) of the memory mat (MAT1) is read out, and, thereafter, in the D/A converting circuit (DAC), the gray scale voltages corresponding to the display data are selected. Further, the video line selection circuit A (SS-A) is turned on, the video line selection circuit (SS-B) is turned off, and the first scanning line (SG1) of the second liquid crystal display panel (SUB) is turned on. Accordingly, the gray scale voltage is written in the first scanning line (SG1) of the screen region A of the second liquid crystal display panel (SUB).

The above-mentioned operation is executed up to the 160th scanning line (SG160), thus writing the gray scale voltages to the screen region A of the second liquid crystal display panel (SUB).

Next, the video line selection circuit A (SS-A) is turned off and the video line selection circuit (SS-B) is turned on, and the above-mentioned operation is executed up to the 320th scanning line (SG320), thus writing the gray scale voltages to the screen region B of the second liquid crystal display panel (SUB).

Accordingly, the image is displayed on the whole screen of the second liquid crystal display panel (SUB).

Here, it is needless to say that by inversely performing the turning on or off of the video line selection circuit A(SS-A) and the video line selection circuit B(SS-B), it is possible to reverse the correspondence between A, B of the memory mat (MAT1) and the screen regions A, B of the second liquid crystal display panel (SUB).

Figure 11:
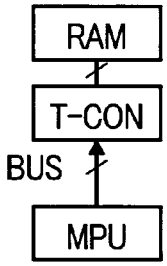
FIG. 11 is a diagram showing the flow of the display data inputted to the memory (RAM) from an MPU through a TFT controller (TCON)

As shown in FIG. 11, the display data which is transmitted from the MPU through a 18 bit data bus (BUS) is transferred to the memory (RAM) through the TFT controller (TCON).

Figure 12:
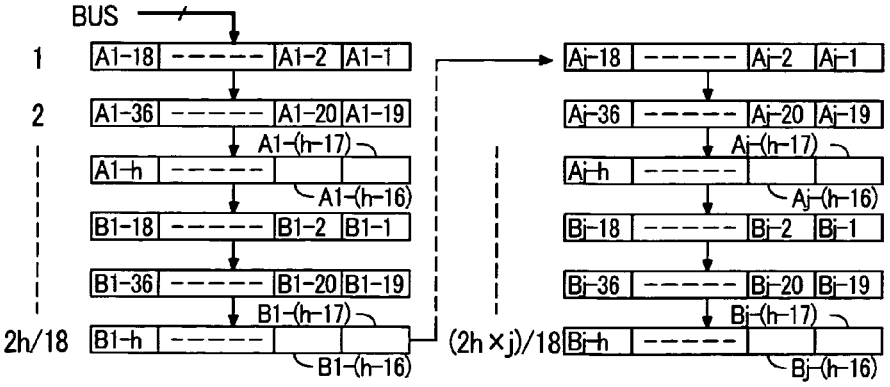
FIG. 12 is a diagram illustrating the serial display data inputted to the memory (RAM) from the MPU through the TFT controller (TCON)

At this point of time, as shown in FIG. 12, the display data is continuously transferred as serial data. For example, first of all, the display data corresponding to the pixels on the first scanning line (SG1) is transferred in series by every 18 bits. Next, the display data corresponding to the pixels on the second scanning line (SG2), . . . , j (here, 160th) is transferred in series by every 18 bits. Here, when the bus width of the data bus (BUS) is 8 bits, the serial transfer of the display data is executed by further dividing 18 bits, such as 8+8+2.

Figure 13:
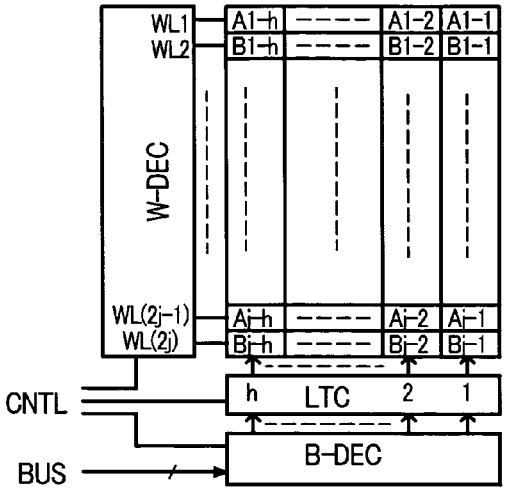
FIG. 13 is a block diagram showing a memory control circuit of the embodiment 2 of the present invention.

FIG. 13 is a view showing a memory control circuit of this embodiment.

The display data which is continuously transferred as shown in FIG. 12 as serial data is transferred to a bit decoder (B-DEC) and a latch circuit (LTC) of the memory (RAM) and is subjected to parallel conversion. Thereafter, the word decoder (W-DEC) may be selected when necessary and the display data is written in the memory mat (MAT1). Here, the above-mentioned operation is executed based on the control signals (CNTL). Accordingly, it is possible to store the display data which is transferred in series into the memory mat (MAT1) in the arrangement shown in FIG. 8. It is also possible to store the display data which is transferred in series into the memory mat (MAT1) in the arrangement shown in FIG. 10.

Here, in conjunction with FIG. 2, an explanation is given with respect to a case in which the video lines of the second liquid crystal display panel (SUB) are divided into halves, each of which is constituted of 180 video lines. However, the video lines of the second liquid crystal display panel (SUB) may be divided in "n" ($n \geqq 3$), for example, in three, such that each section is constituted of 120 video lines.

Figure 14:
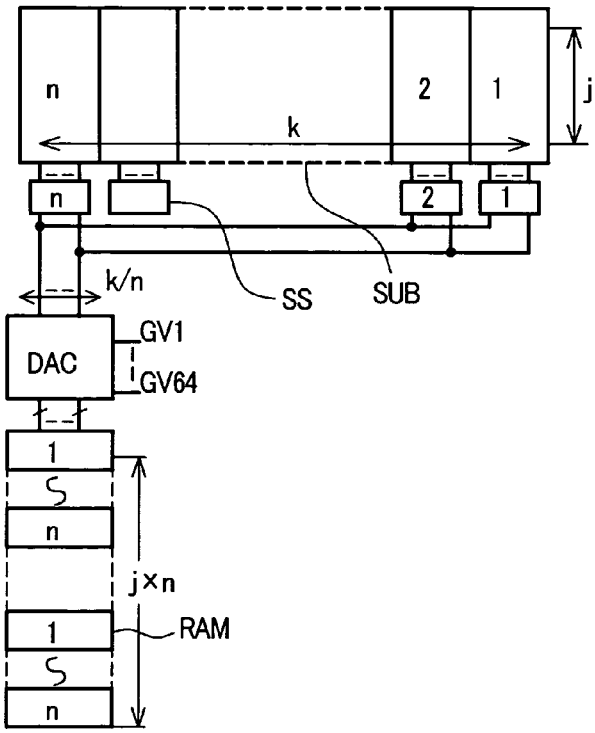
FIG. 14 is a block diagram showing a modification of the liquid crystal display module of the embodiment 2 of the present invention.

FIG. 14 shows the video lines of the second liquid crystal display panel (SUB) when the video lines are divided in "n". In this case, assuming that the total number of video lines of the second liquid crystal display panel (SUB) is "k", the number of outputs from the D/A converting circuit (DAC) becomes k/n, and, at the same time, the memory (RAM) is also constituted of $(k/n)\times(j\times n)$ memory elements.

Figure 15:
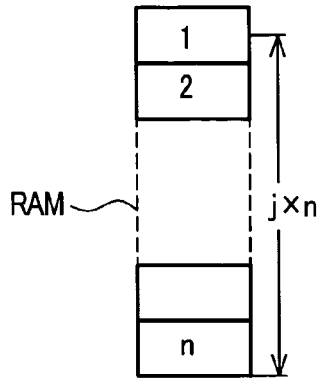
FIG. 15 is a diagram showing one example in which a memory mat (MAT1) and sub pixels of the second liquid crystal display panel (SUB) are made to correspond to each other in a modification of the embodiment 2 of the present invention.

Further, in this case, the example of correspondence between the memory mat (MAT1) and the sub pixels of the second liquid crystal display panel (SUB) becomes as shown in FIG. 14 and FIG. 15. Here, the example shown in FIG. 14 corresponds to the example shown in FIG. 8, while the example shown in FIG. 15 corresponds to the example shown in FIG. 10.

Embodiment 3

The liquid crystal display module of this third embodiment will be explained by particularly focusing on points which make this embodiment different from the previously explained embodiment 2.

The liquid crystal display module of this embodiment differs from the previously-mentioned liquid crystal display module of the embodiment 2 with respect to the point that the second liquid crystal display panel (SUB) is divided into 180 sets in which two neighboring video lines form one set and a video line selection circuit (SS) alternately connects two video lines of each set to the corresponding connection lines among the connection lines for video lines of the flexible printed circuit board (FPC2) in time-shared processing.

In the previously-mentioned embodiment, for example, the line which connects the output line (S180) of the D/A converting circuit (DAC) and the video line (SS180) of the second liquid crystal display panel (SUB) crosses the output lines (SI80 to S179) of the D/A converting circuit (DAC). However, in this embodiment, the crossing of lines from the D/A converting circuit (DAC) to the respective video lines of the second liquid crystal display panel (SUB) can be eliminated. Accordingly, it is possible not only to make the resistance of the lines to which the D/A converting circuit (DAC) is connected uniform, but also to adopt one-layer lines as the lines which connect the D/A converting circuit (DAC) and the thin film transistor (STFT) on the glass substrate, whereby the wiring area can be narrowed, thus lowering the manufacturing cost.

Figure 16:
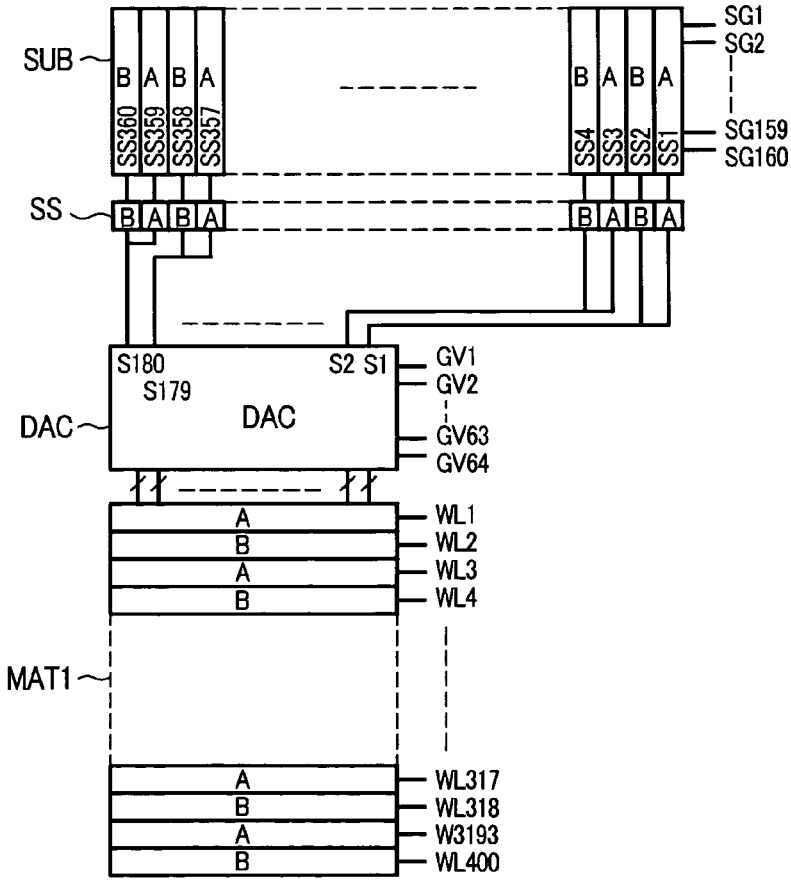
FIG. 16 is a diagram showing one example in which a memory mat (MAT1) and sub pixels of the second liquid crystal display panel (SUB) are made to correspond to each other in a liquid crystal display module representing an embodiment 3 of the present invention.

FIG. 16 is a view showing one example in which a memory mat (MAT1) and sub pixels of the second liquid crystal display panel (SUB) are made to correspond to each other in a liquid crystal display module of an embodiment 3 of the present invention.

In the case shown in FIG. 16, the display data of the first word line (WL1) of the memory mat (MAT11) is read out and the gray scale voltage corresponding to the display data is selected at the D/A converting circuit (DAC). Further, the video line selection circuit A (SS-A) is turned on, the video line selection circuit (SS-B) is turned off, and the first scanning line (SG1) of the second liquid crystal display panel (SUB) is turned on. Accordingly, the gray scale voltage is written in the first scanning line (SG1) of the screen region A of the second liquid crystal display panel (SUB).

Next, the display data of the second word line (WL2) of the memory mat (MAT1) is read out and the gray scale voltage corresponding to the display data is selected at the D/A converting circuit (DAC). Further, the video line selection circuit A (SS-A) is turned off, the video line selection circuit B (SS-B) is turned on, and the first scanning line (SG1) of the second liquid crystal display panel (SUB) is held in an ON state. Accordingly, the gray scale voltage is written in the first scanning line (SG1) of the screen region B of the second liquid crystal display panel (SBU).

The above-mentioned operation is executed up to the 160th scanning line (SG160) so as to display the image on the whole screen of the second liquid crystal display panel (SUB).

Figures 17, 18:
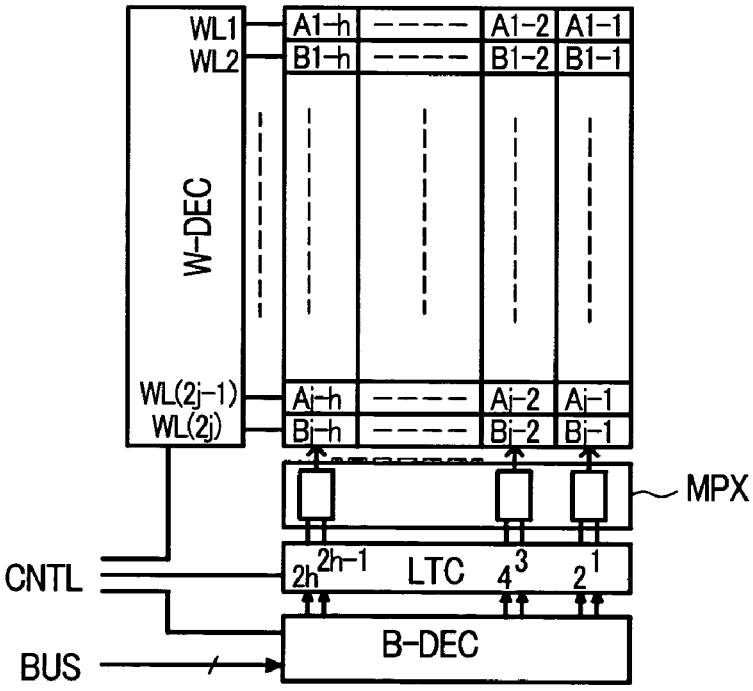
FIG. 17 is a diagram showing the relationship between the display data stored in the memory mat (MAT1) and the sub pixels to which gray scale voltages are applied based on the display data when the number of sub pixels in the second liquid crystal display panel (SUB) is 6×3×3 in the embodiment 3 of the present invention.
FIG. 18 is a block diagram showing a memory control circuit of the embodiment 3.

FIG. 17 shows the relationship between the display data stored in the memory mat (MAT1) and the sub pixels to which the gray scale voltages are applied based on the display data when the number of sub pixels in the second liquid crystal display panel (SUB) is 6×3×3.

Due to the above-mentioned operations, the gray scale voltages corresponding to the display data of 1, 3, . . . , 17 stored in the memory elements of the word line (WL1) shown in FIG. 17 are written in the pixels corresponding to the odd-numbered video lines (SS1, SS3, . . . , SS17) on the display line corresponding to the scanning line (SG1), while the gray scale voltages corresponding to the display data of 2, 4, . . . , 18 stored in the memory elements of the word line (WL2) are written in the pixels corresponding to the even-numbered video lines (SS2, SS4, . . . , SS18) on the display line corresponding to the scanning line (SG1).

In the same manner, the gray scale voltages corresponding to the display data of 19, 21, . . . , 35 stored in the memory elements of the word line (WL3) are written in the pixels corresponding to the odd-numbered video lines (SS1, SS3, . . . , SS17) on the display line corresponding to the scanning line (SG2), while the gray scale voltages corresponding to the display data of 20, 22, . . . , 36 stored in the memory elements of the word line (WL4) are written in the pixels corresponding to the even-numbered video lines (SS2, SS4, . . . , SS18) on the display line corresponding to the scanning line (SG2).

Further, the gray scale voltages corresponding to the display data of 37, 39, . . . , 53 stored in the memory elements of the word line (WL5) are written in the pixels corresponding to the odd-numbered video lines (SS1, SS3, . . . , SS17) on the display line corresponding to the scanning line (SG3), while the gray scale voltages corresponding to the display data of 38, 40, . . . , 54 stored in the memory elements of the word line (WL6) are written in the pixels corresponding to the even-numbered video lines (SS2, SS4, . . . , SS18) on the display line corresponding to the scanning line (SG3).

Here, it is needless to say that by inversely performing the turning on or off of the video line selection circuit A(SS-A) and the video line selection circuit B(SS-B), it is possible to reverse the correspondence between A, B of the memory mat (MAT1) and the screen regions A, B of the second liquid crystal display panel (SUB).

Further, in this embodiment, the display data stored in the memory mat (MAT1) may be formed as shown in FIG. 10. In this embodiment, when the display data stored in the memory mat (MAT1) is formed as shown in FIG. 10, the display data on the first word line (WL1) of the memory mat (MAT1) is read out, and, thereafter, in the D/A converting circuit (DAC), the gray scale voltages corresponding to the display data are selected.

Further, the video line selection circuit A (SS-A) is turned on, the video line selection circuit B(SS-B) is turned off, and the first scanning line (SG1) of the second liquid crystal display panel (SUB) is turned on. Accordingly, the gray scale voltage is written in the pixels on the first scanning line (SG1) of the screen region A of the second liquid crystal display panel (SUB).

The above-mentioned operation is executed up to the 160th scanning line (SG160), thus writing the gray scale voltages to the screen region A of the second liquid crystal display panel (SUB).

Next, the video line selection circuit A (SS-A) is turned off and the video line selection circuit B(SS-B) is turned on, and the above-mentioned operation is executed up to the 320th scanning line (SG320), thus writing the gray scale voltages to the screen region B of the second liquid crystal display panel (SUB). Accordingly, the image is displayed on the whole screen of the second liquid crystal display panel (SUB).

Also, in this embodiment, as shown in FIG. 11, the display data which is transmitted from the MPU through a 18 bit data bus (BUS) is transferred to the memory (RAM) through the TFT controller (TCON). At this point of time, as shown in FIG. 12, the display data are continuously transferred as serial data.

FIG. 18 is a view showing a memory control circuit of this embodiment.

As shown in FIG. 12, the display data which is continuously transferred as serial data is transferred to a bit decoder (B-DEC) and a latch circuit (LTC) of the memory (RAM) and is subjected to the parallel conversion.

In this embodiment, the serial data is present in a mixture of the display data A and the display data B shown in FIG. 16, and, hence, the latch circuit (LTC), which includes latch elements for two words so as to latch the display data for two words, and a multiplexer (MPX) are provided. For example, the display data A is stored in the odd-numbered latch element and the display data B is stored in the even-numbered latch element, thus forming parallel data.

After the display data is subjected to parallel conversion, the word decoder (W-DEC) is suitably selected and the display data is written in the memory mat (MAT1).

Here, when an odd-numbered line is selected by the word decoder (W-DEC), the display data of an odd-numbered latch element is selected by the multiplexer (MPX); while, when an even-numbered line is selected by the word decoder (W-DEC), the display data of an even-numbered latch element is selected.

Accordingly, it is possible to store the display data transferred in the serial transfer mode in the memory mat (MAT1) with the arrangement shown in FIG. 16. It is also possible to store the display data transferred in the serial transfer mode in the memory mat (MAT1) with the arrangement shown in FIG. 10.

In conjunction with FIG. 16, an explanation has been given with respect to a case in which 360 video lines of the second liquid crystal display panel (SUB) are divided into 180 sets, each of which is formed of two neighboring video lines. However, the video lines of the second liquid crystal display panel (SUB) may be divided into 360/n sets, each of which is formed of n (n>3) neighboring video lines, for example, 120 sets, each of which is formed of three neighboring video lines.

Figure 19:
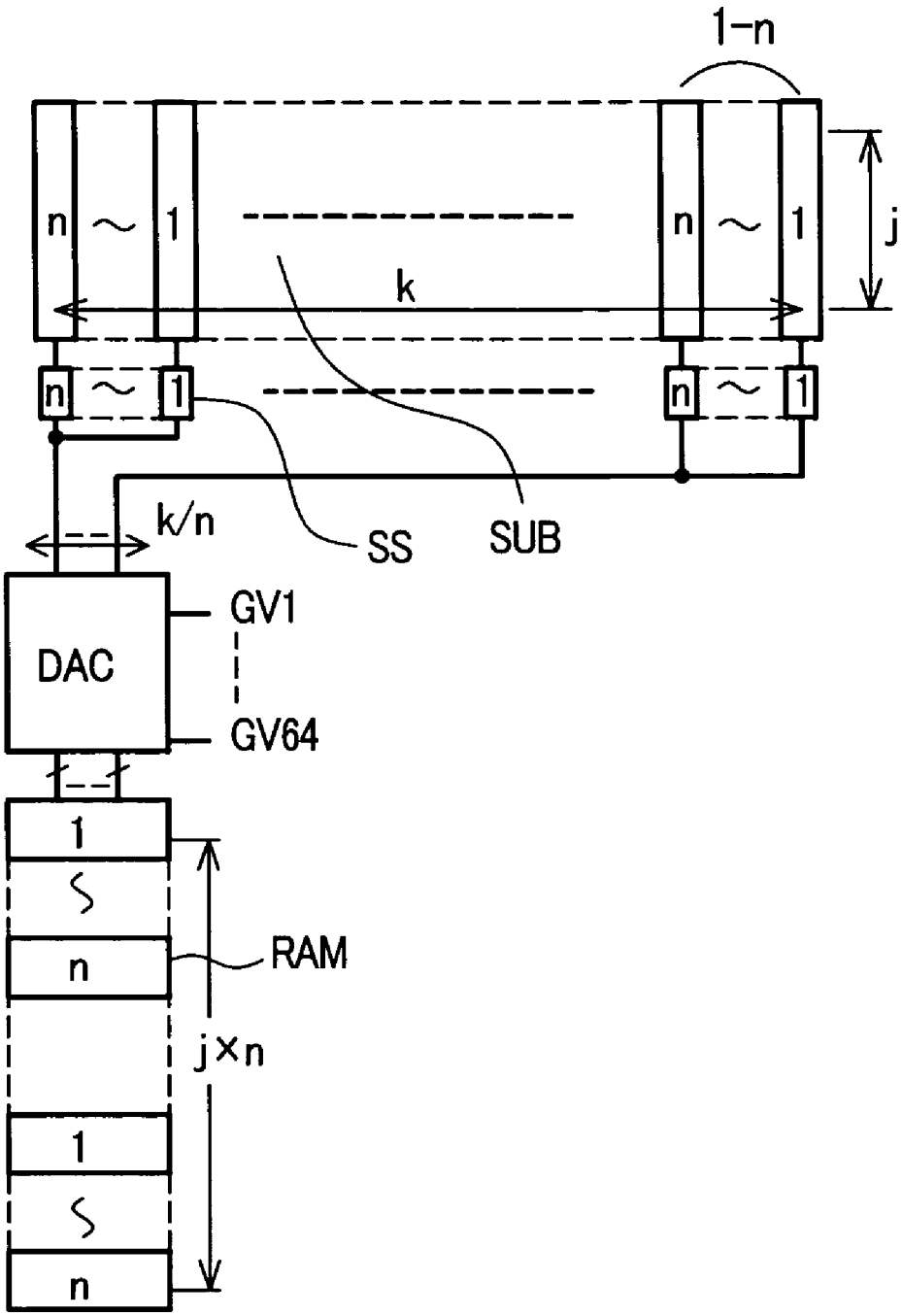
FIG. 19 is a block diagram showing a modification of the liquid crystal display module of the embodiment 3 of the present invention.

FIG. 19 shows the constitution in which the k video lines of the second liquid crystal display panel (SUB) is divided into k/n sets, each of which is formed of n (n≧3) neighboring video lines. In this case, the number of outputs from the D/A converting circuit (DAC) becomes k/n, and, at the same time, the memory (RAM) is also constituted of (k/n)×(j×n) memory elements. Further, in this case, the example of correspondence between the memory mat (MAT1) and the sub pixels of the second liquid crystal display panel (SUB) becomes as shown in FIG. 19. Here, the example shown in FIG. 19 corresponds to the example shown in FIG. 16.

Figure 20:
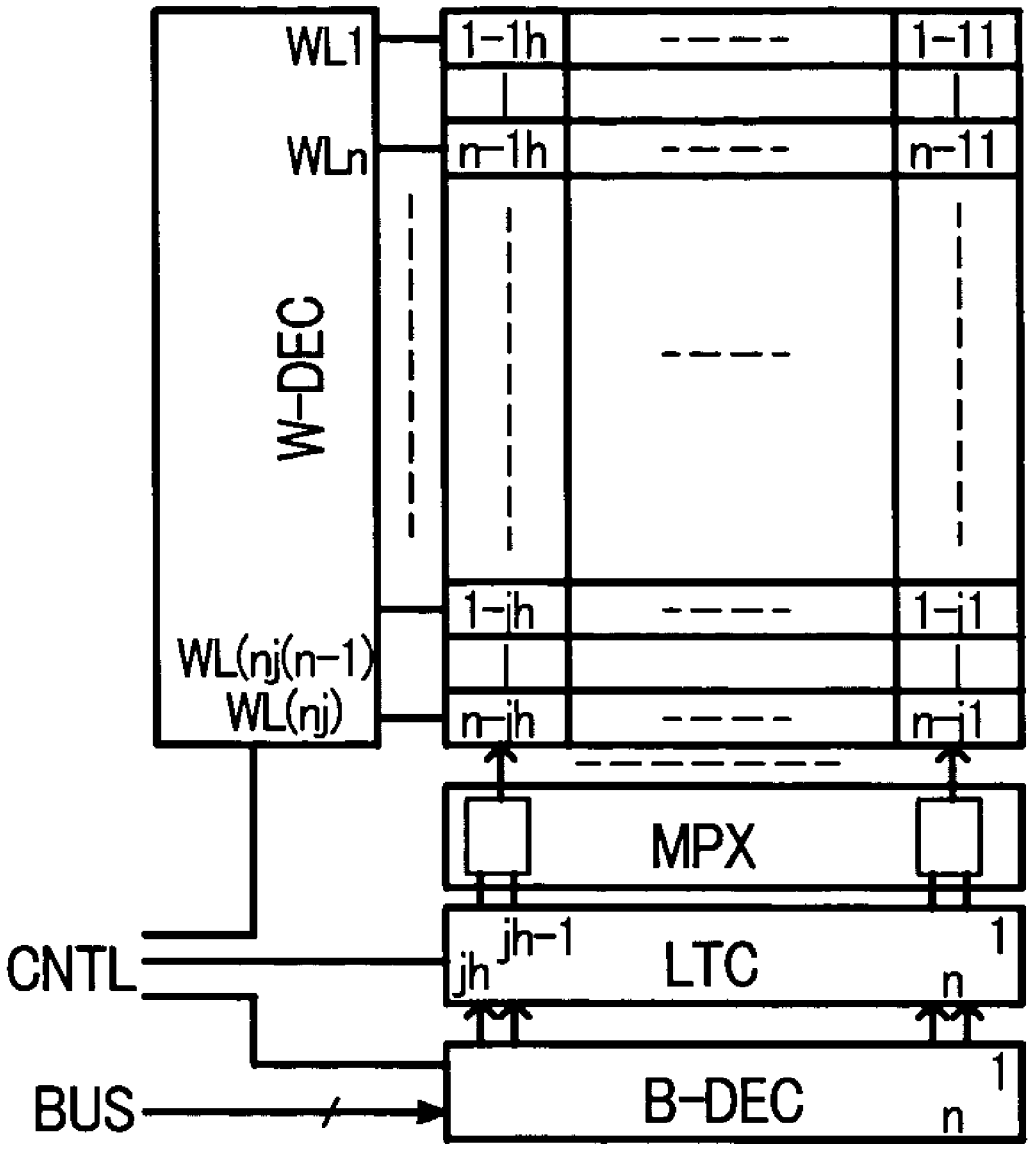
FIG. 20 is a block diagram showing a memory control circuit of a modification of the embodiment 3 of the present invention.

FIG. 20 shows the memory control circuit when the k video lines of the second liquid crystal display panel (SUB) are divided into k/n sets, each of which is formed of n (n≧3) neighboring video lines.

In the case shown in FIG. 20, the serial data is constituted of the display data from 1 to n present in a mixed form, as shown in FIG. 19, and, hence, a latch circuit which has latch elements for n words and latches the display data for n words and a multiplexer (MPX) are provided. For example, the display data of 1 to n is sequentially stored in the first to nth latch elements, thus forming parallel data.

After the display data is subjected to parallel conversion, the word decoder (W-DEC) is suitably selected and the display data is written in the memory mat (MAT1).

Here, when the first to nth lines are sequentially selected using the word decoder (W-DEC), the multiplexer (MPX) selects the display data on the first to the nth latch element.

Accordingly, it is possible to store the display data transferred in the serial transfer mode in the memory mat (MAT1) with the arrangement shown in FIG. 19.

Embodiment 4

Figure 21:
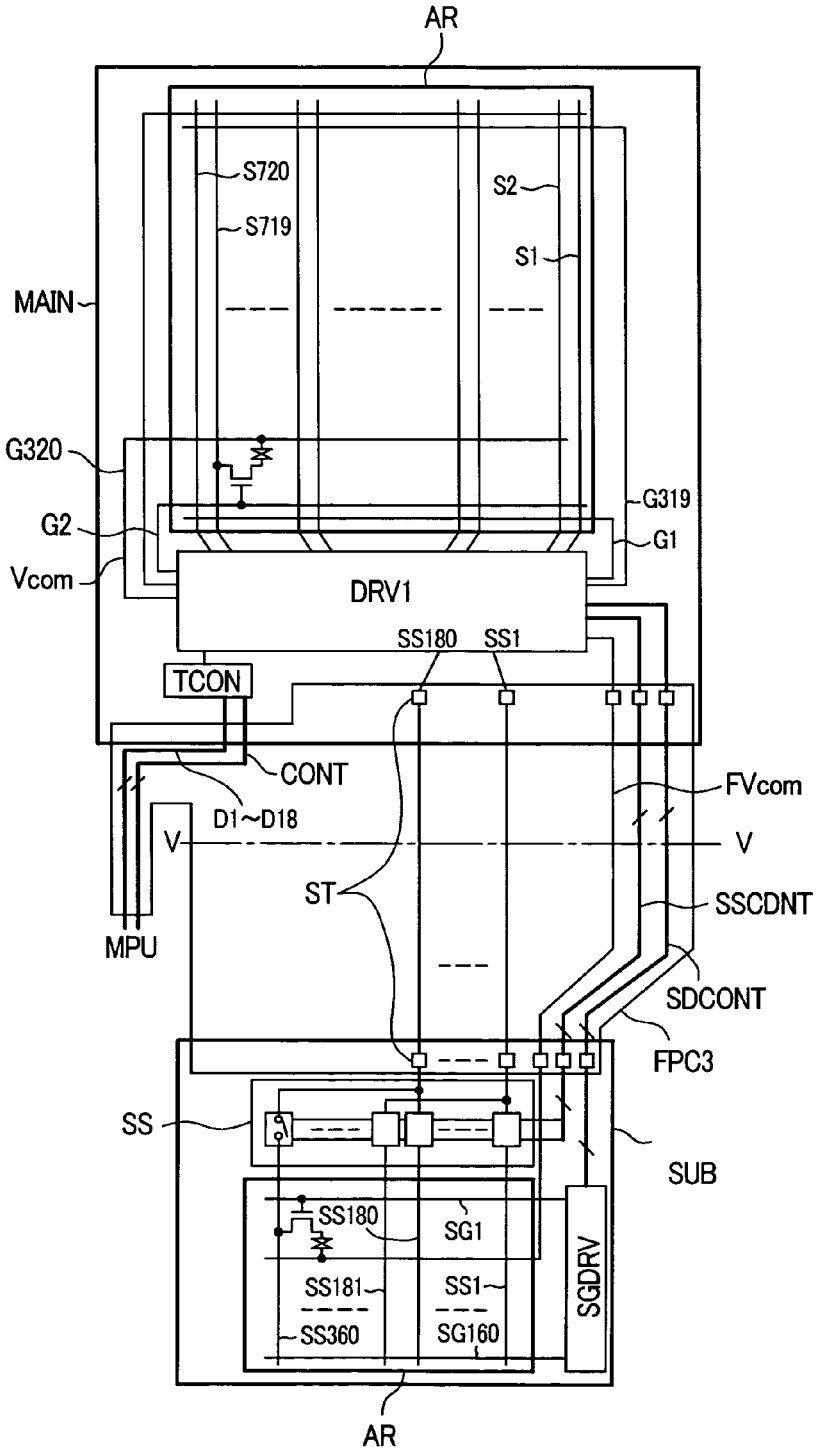
FIG. 21 is a block diagram showing the constitution of a liquid crystal display module representing an embodiment 4 of the present invention.

FIG. 21 is a diagram showing the constitution of a liquid crystal display module representing an embodiment 4 of the present invention.

The liquid crystal display module of this embodiment differs from the previously-mentioned embodiment 2 with respect to a point that the first liquid crystal display panel (MAIN) and the second liquid crystal display panel (SUB) are configured such that the display region (AR) of the first liquid crystal display panel (MAIN) and the display region (AR) of the second liquid crystal display panel (SUB) are arranged to face each other with the liquid crystal driver (DRV) therebetween.

The liquid crystal display module of this embodiment will be explained hereinafter by focusing on the point which makes this embodiment different from the above-mentioned embodiment 2.

In this embodiment, the first liquid crystal display panel (MAIN) and the second liquid crystal display panel (SUB) are connected with each other using a flexible printed circuit board (FPC3), such that the display region (AR) of the first liquid crystal display panel (MAIN) and the display region (AR) of the second liquid crystal display panel (SUB) are arranged to face each other with the liquid crystal driver (DRV) therebetween.

When the liquid crystal display module of this embodiment is mounted on a mobile phone, the liquid crystal display module is used in a folding manner along a broken line V.

In the above-mentioned embodiment 2, even when only the second liquid crystal display panel (SUB) is displayed, the video lines of the first liquid crystal display panel (MAIN) are also charged, and, hence, an extra load is generated. In this embodiment, however, the video lines of the first liquid crystal display panel (MAIN) and the video lines of the second liquid crystal display panel (SUB) are respectively independently separated from each other, and, hence, the extra load is eliminated, whereby the power consumption can be reduced.

Further, since the first liquid crystal display panel (MAIN) and the second liquid crystal display panel (SUB) can be scanned arbitrarily (for example, simultaneously), the frame frequency can be optimized with respect to the first liquid crystal display panel (MAIN) and the second liquid crystal display panel (SUB), whereby the power consumption can be reduced.

Here, also in the above-mentioned embodiment 1, the first liquid crystal display panel (MAIN) and the second liquid crystal display panel (SUB) may be arranged such that the display region (AR) of the first liquid crystal display panel (MAIN) and the display region (AR) of the second liquid crystal display panel (SUB) face each other with the liquid crystal driver (DRV) therebetween.

Embodiment 5

Figure 22:
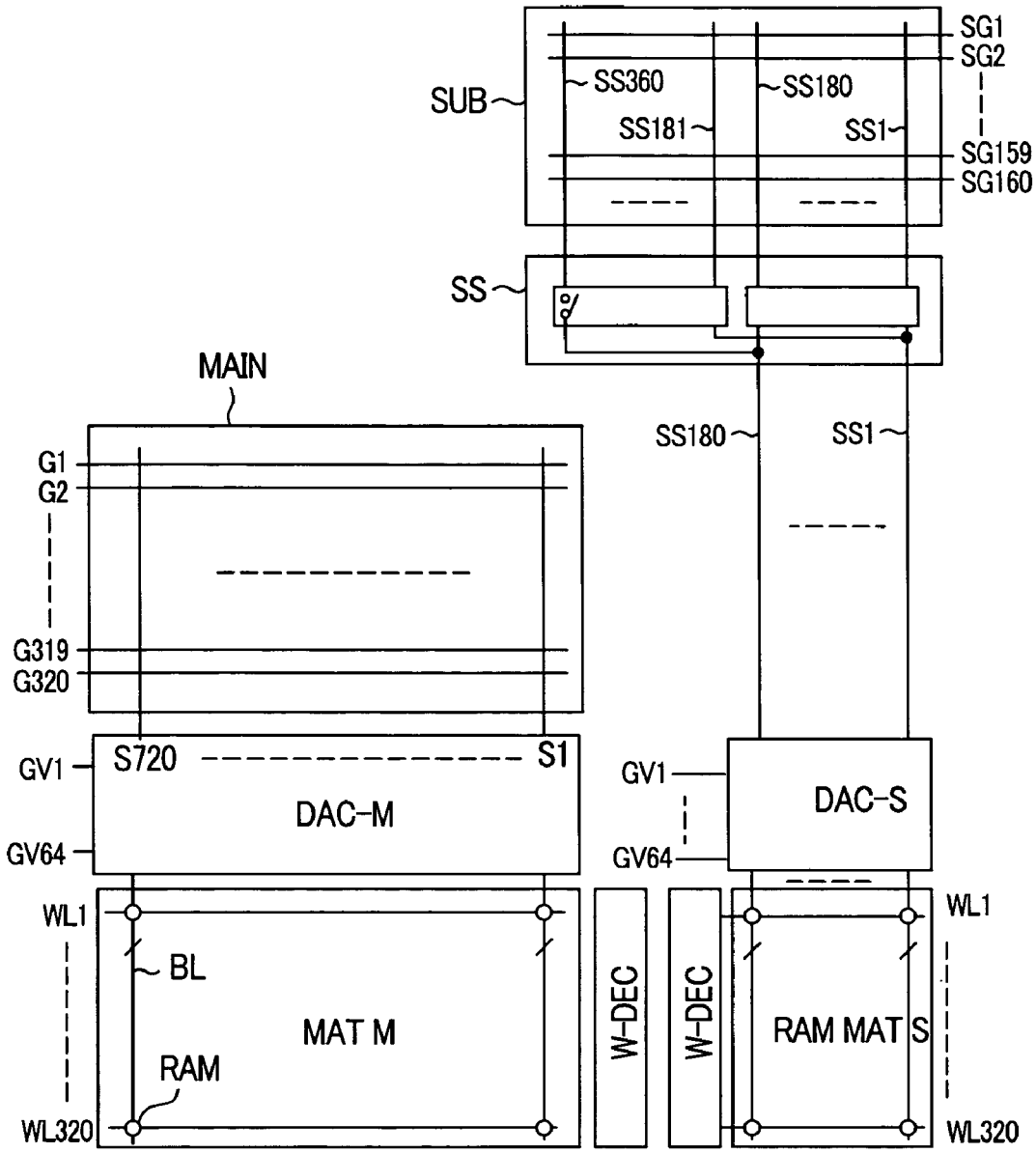
FIG. 22 is a block diagram showing the constitution of a liquid crystal display module representing an embodiment 5 of the present invention.

FIG. 22 is a diagram showing the constitution of a liquid crystal display module representing an embodiment 5 of the present invention.

The liquid crystal display module of this embodiment differs from the liquid crystal display module of the above-mentioned embodiment 2 with respect to a point that the memory and the D/A converter are independently provided for the first liquid crystal display panel (MAIN) and the second liquid crystal display panel (SUB). Hereinafter, the liquid crystal display module of this embodiment will be explained by focusing on the above-mentioned point which makes this embodiment different from the embodiment 2.

As shown in FIG. 22, in this embodiment, the gray scale voltages are supplied to the first liquid crystal display panel (MAIN) using a memory mat (MAT M) and a D/A converter (DAC-M), while the gray scale voltages are supplied to the second liquid crystal display panel (SUB) using a memory mat (MAT S) and a D/A converter (DAC-S).

According to this embodiment, it is possible to simultaneously display the first liquid crystal display panel (MAIN) and the second liquid crystal display panel (SUB).

In the above-mentioned embodiment 2, even when only the second liquid crystal display panel (SUB) is displayed, the video lines of the first liquid crystal display panel (MAIN) are also charged, and, hence, an extra load is generated. In this embodiment, however, as shown in FIG. 22, the video lines of the first liquid crystal display panel (MAIN) and the video lines of the second liquid crystal display panel (SUB) are respectively independently separated from each other, and, hence, the extra load is eliminated, whereby the power consumption can be reduced.

Further, in this embodiment, in arranging the memory mat (MAT M) for the first liquid crystal display panel (MAIN) and the memory mat (MAT S) for the second liquid crystal display panel (SUB) in the inside of the liquid crystal driver (DRV), due to a display size of the second liquid crystal display panel (SUB), the memory mat (MAT S) can be arranged on the lateral side of the memory mat (MAT M) with a height (Y direction) substantially equal to a height of the memory mat (MAT M), and, hence, an area of the liquid crystal driver (DRV) on a glass substrate can be reduced. In this manner, the dependency of the display device on the size of the second liquid crystal display panel (SUB) is recognized only in substantially the X direction, and, hence, a dead space can be reduced, whereby the manufacturing cost can be reduced.

Embodiment 6

Figure 23:
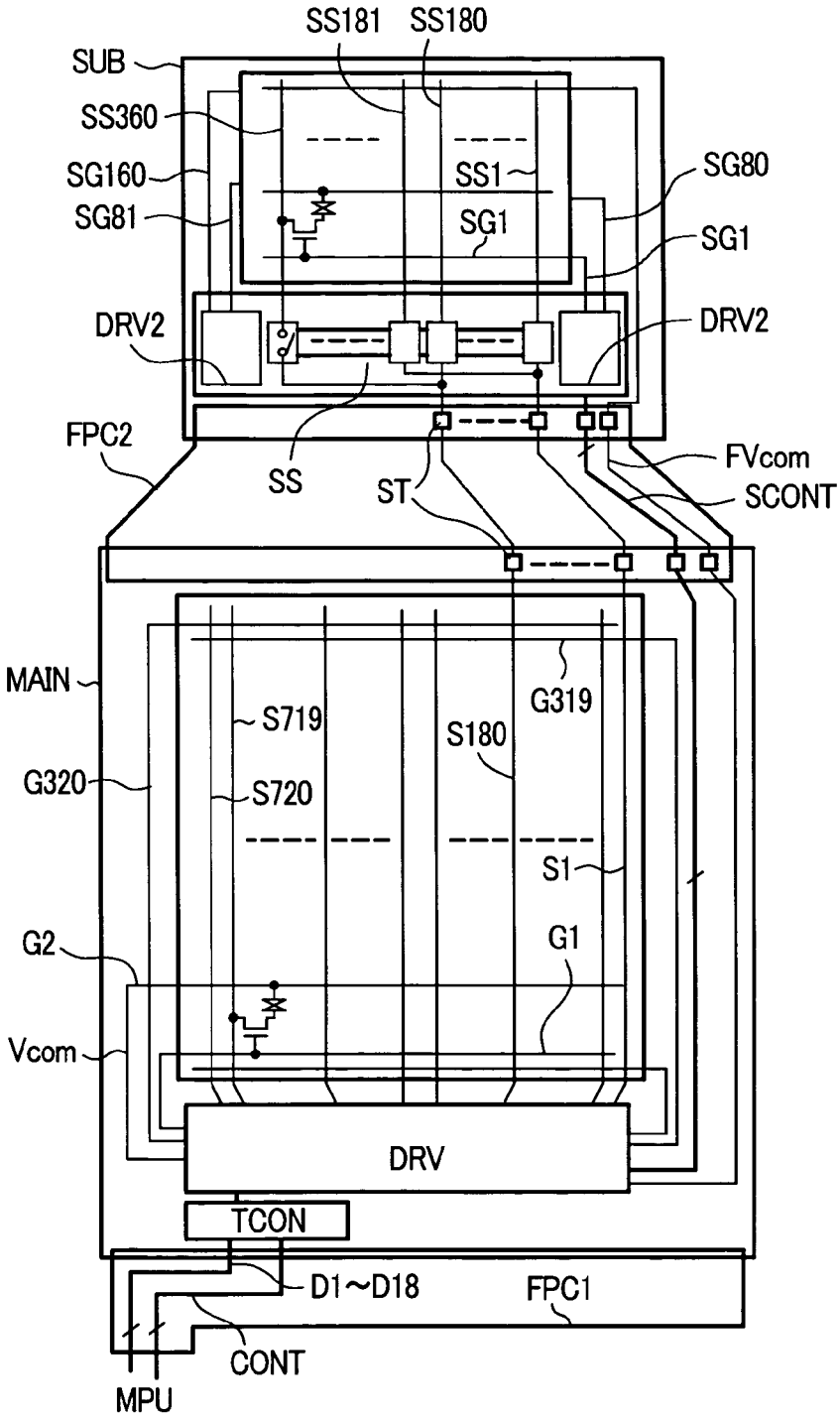
FIG. 23 is a block diagram showing the constitution of a liquid crystal display module representing an embodiment 6 of the present invention.

FIG. 23 is a diagram showing the constitution of a liquid crystal display module representing an embodiment 6 of the present invention. The liquid crystal display module of this embodiment will be explained hereinafter by focusing on a point which makes this embodiment different from the above-mentioned embodiment 2.

In this embodiment, as shown in FIG. 23, a sub scanning line drive circuit (SGDRV) is divided into two scanning line drive circuits (DRV2). One scanning line drive circuit (DRV2) drives the first to 80th scanning lines (SG1 to SG80) of the second liquid crystal display panel (SUB), and the other scanning line drive circuit (DRV2) drives the 81st to 160th scanning lines (SG81 to SG160) of the second liquid crystal display panel (SUB).

Here, it is also possible to adopt a constitution in which one scanning line drive circuit (DRV2) drives the odd-numbered scanning lines of the second liquid crystal display panel (SUB) and the other scanning line drive circuit (DRV2) drives the even-numbered scanning lines of the second liquid crystal display panel (SUB).

Embodiment 7

Figure 24:
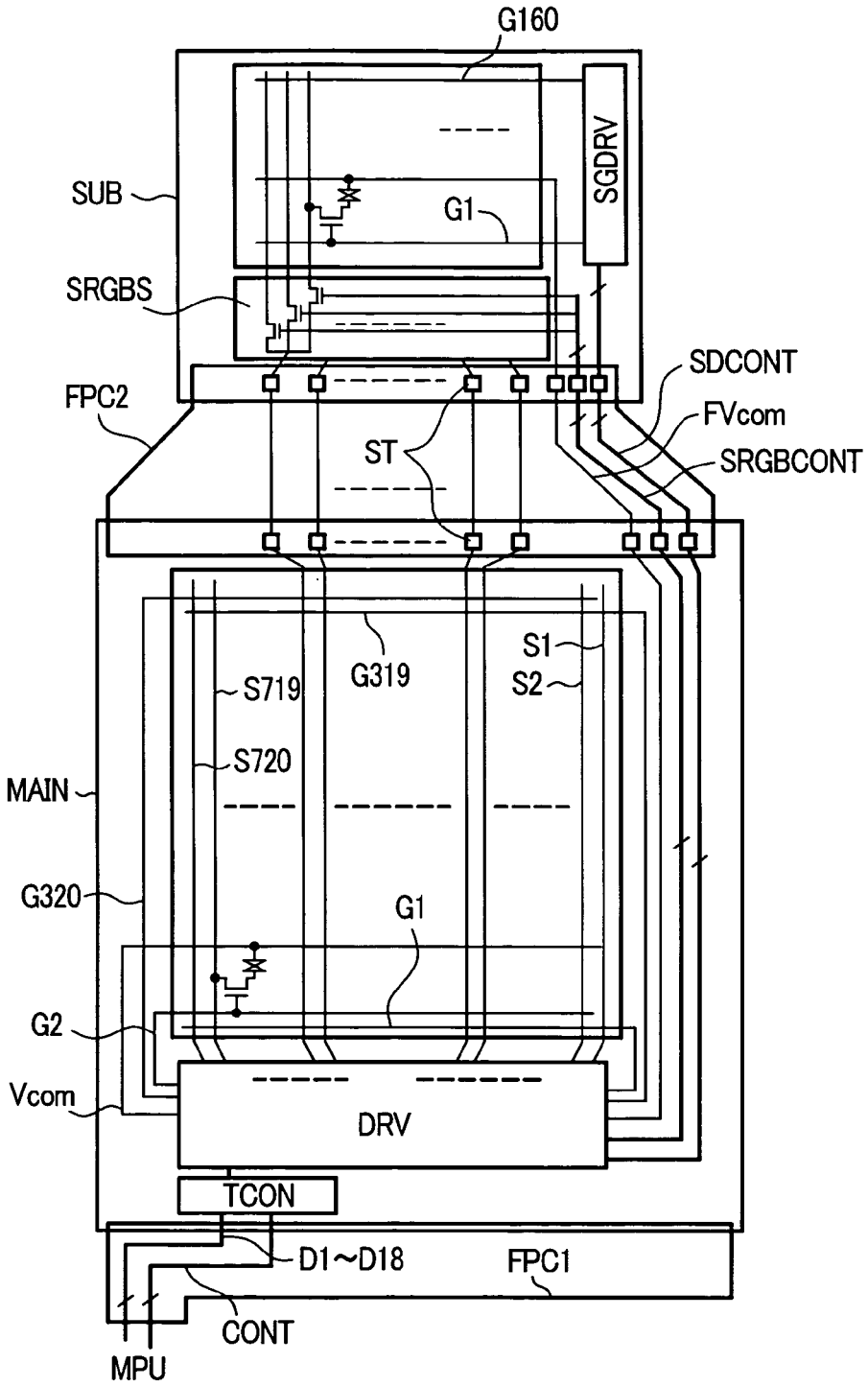
FIG. 24 is a block diagram showing the constitution of a liquid crystal display module representing an embodiment 7 of the present invention.

FIG. 24 is a diagram showing the constitution of a liquid crystal display module representing an embodiment 7 of the present invention.

The liquid crystal display module of this embodiment differs from the above-mentioned embodiment 3 with respect to a point that the video lines of the second liquid crystal display panel (SUB) are divided into 120 sets, each of which is constituted of three neighboring video lines of R (red), G (green), B (blue), and the video lines of R (red), G (green), B (blue) of each set are sequentially connected in time-shared processing with corresponding connection lines among connection lines for video lines in the flexible printed circuit board (FPC2).

The liquid crystal display module of this embodiment will be explained hereinafter by focusing on the point which makes this embodiment different from the above-mentioned embodiment 3.

In the liquid crystal display module of this embodiment, the video lines of the second liquid crystal display panel (SUB) are divided into 120 sets, each of which is formed of three neighboring video lines of R (red), G (green), B (blue). Further, an RGB selection circuit (SRGBS) alternately and in time-shared processing connects the video lines of R (red), G (green), B (blue) of each set to the corresponding connection lines among the connection lines for video lines of the flexible printed circuit board (FPC2).

Accordingly, as in the case of this embodiment, when the number of sub pixels of the second liquid crystal display panel (SUB) is 120×3×160, assuming that the number of signal lines for RGB selection circuit control signals (SRGBCONT) which control the RBG selection circuit (SRGBS) is three, according to this embodiment, the connection lines of the video flexible printed circuit board (FPC2) can be reduced to 133 lines (120 lines for video lines+13 lines for control signals or the like).

In this manner, according to this embodiment, it is possible to further reduce the number of connection lines of the flexible printed circuit board (FPC2).

Figure 25:
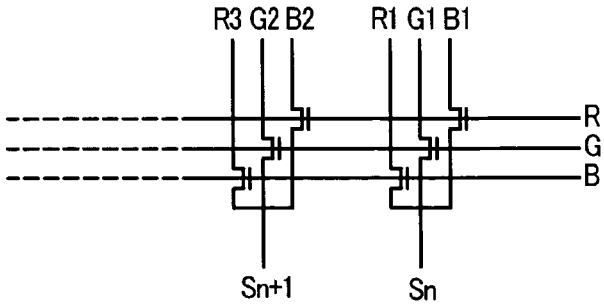
FIG. 25 is a schematic diagram showing details of an RGB selection circuit (SRGBS) shown in FIG. 24.
Figure 26:
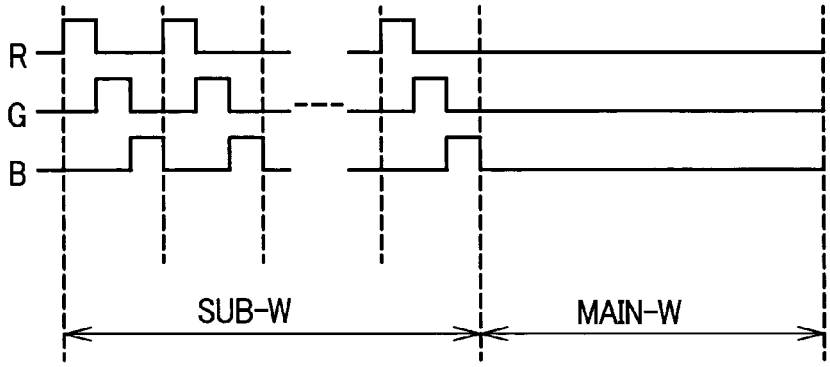
FIG. 26 is a timing chart illustrating operation of the switching circuit shown in FIG. 25.

FIG. 25 is a view showing details of the RGB selection circuit (SRGBS) shown in FIG. 24. The RGB selection circuit (SRGBS) is constituted of a switching circuit which uses MOS transistors as switching elements. FIG. 26 is a timing chart illustrating the operation of the switching circuit shown in FIG. 25.

As shown in FIG. 26, the R, G, B signals of the RGB selection circuit control signals (SRGBCONT), which control the RGB selection circuit (SRGBS), assume a High level or a Low level only during the writing period (SUB-W) of the second liquid crystal display panel (SUB) and turn on or off the switching circuit. Further, the R, G, B signals are fixed to the Low level during the writing period (MAIN-W) of the first liquid crystal display panel (MAIN) and turn off the switching circuit.

Due to such a constitution, at the time of performing the writing in the first liquid crystal display panel (MAIN), the capacitance of the video lines of the second liquid crystal display panel (SUB) from the liquid crystal driver (DRV) is not recognized; and, hence, the load capacitance can be made uniform (that is, the writing time can be made uniform), and, at the same time, the power consumption can be reduced.

Figure 27:
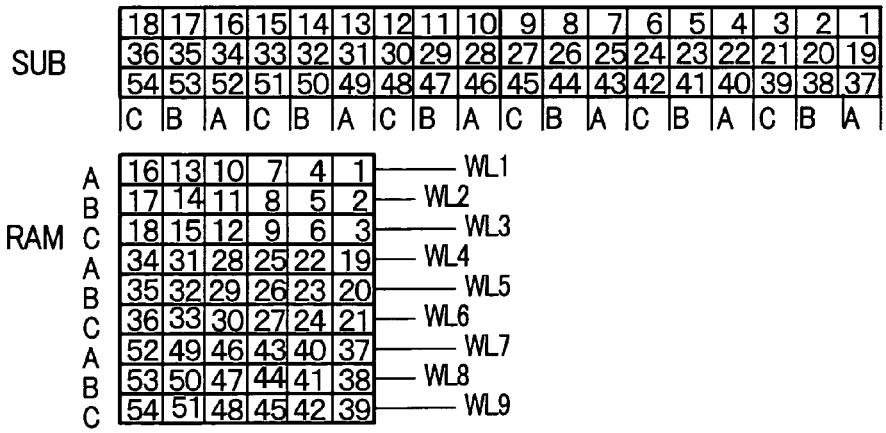
FIG. 27 is a diagram showing the relationship between the display data stored in the memory mat (MAT1) and the sub pixels to which gray scale voltages are applied based on the display data when the number of sub pixels in the second liquid crystal display panel (SUB) is 6×3×3 in this embodiment.

In conjunction with this embodiment, FIG. 27 is a view showing the relationship between the display data stored in the memory mat (MAT1) and the sub pixels to which gray scale voltages are applied based on the display data when the number of sub pixels in the second liquid crystal display panel (SUB) is 6×3×3.

In FIG. 27, gray scale voltages corresponding to the display data of 1, 4, . . . 16 stored in the memory elements of the word line (WL1), gray scale voltages corresponding to the display data of 2, 5, . . . 17 stored in the memory elements of the word line (WL2), and gray scale voltages corresponding to the display data of 3, 6, . . . 18 stored in the memory elements of the word line (WL3) are written in the pixels corresponding to respective video lines on the display lines corresponding to the scanning line (SG1).

In the same manner, gray scale voltages corresponding to the display data of 19, 22, . . . 34 stored in the memory elements of the word line (WL4), gray scale voltages corresponding to the display data of 20, 23, . . . 35 stored in the memory elements of the word line (WL5), and gray scale voltages corresponding to the display data of 21, 24, . . . 36 stored in the memory elements of the word line (WL6) are written in the pixels corresponding to respective video lines on the display lines corresponding to the scanning line (SG2).

Similarly, gray scale voltages corresponding to the display data of 37, 40, . . . 52 stored in the memory elements of the word line (WL7), gray scale voltages corresponding to the display data of 38, 41, . . . 53 stored in the memory elements of the word line (WL8), and gray scale voltages corresponding to the display data of 39, 42, . . . 54 stored in the memory elements of the word line (WL9) are written in the pixels corresponding to respective video lines on the display lines corresponding to the scanning line (SG3).

Here, in this embodiment, the correspondence between the memory mat (MAT1) and the sub pixels of the second liquid crystal display panel (SUB) is substantially equal to the correspondence when the video lines of the second liquid crystal display panel (SUB) is divided into 120 sets, each of which is formed of three neighboring video lines, in the above-mentioned embodiment 3.

Accordingly, a repeated explanation of the correspondence between the memory mat (MAT1) and the sub pixels of the second liquid crystal display panel (SUB) in this embodiment is omitted.

Embodiment 8

Figure 28:
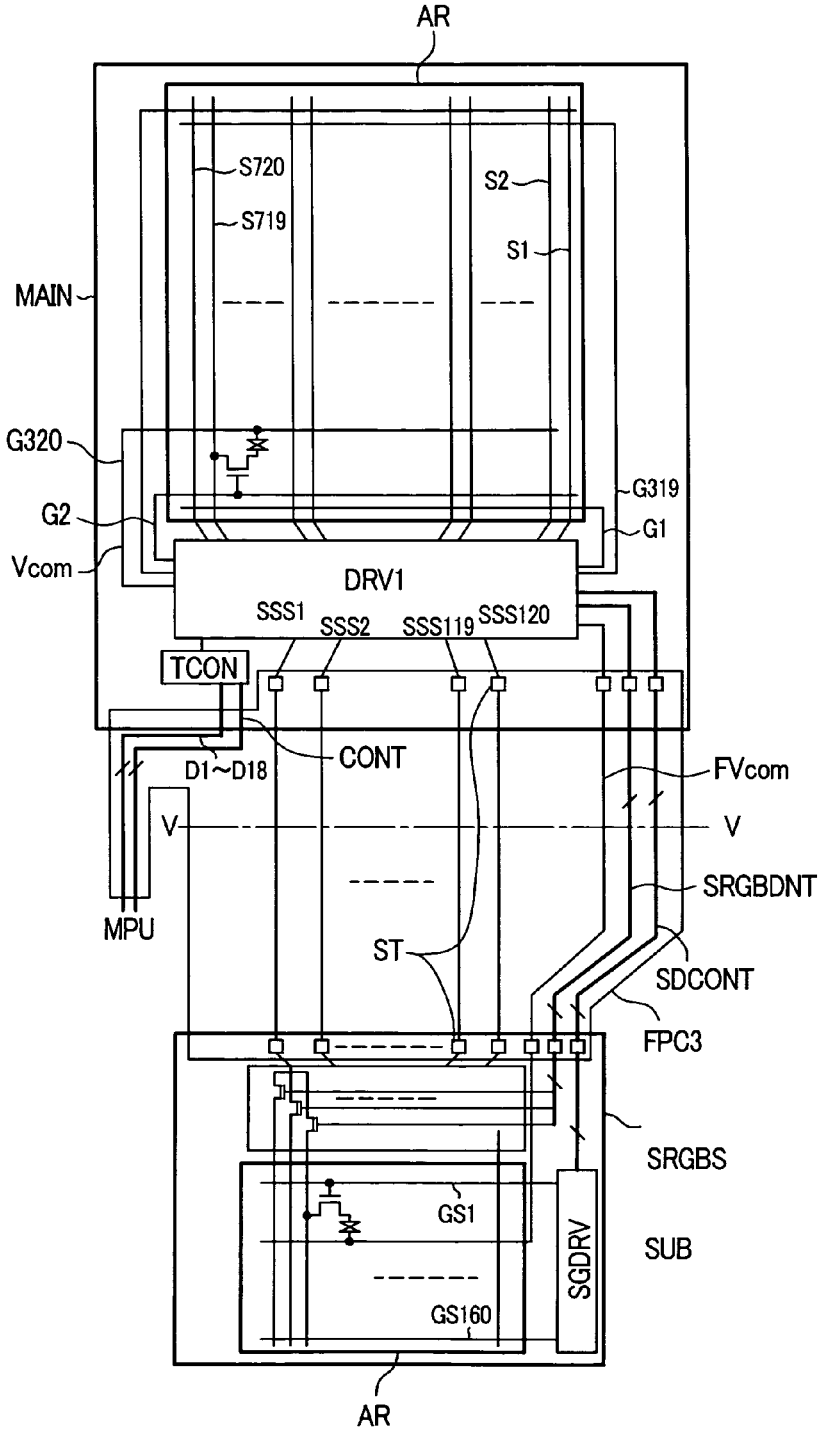
FIG. 28 is a block diagram showing the constitution of a liquid crystal display module representing an embodiment 8 of the present invention.

FIG. 28 is a diagram showing the constitution of a liquid crystal display module representing an embodiment 8 of the present invention.

The liquid crystal display module of this embodiment differs from the above-mentioned embodiment 7 with respect to a point that the first liquid crystal display panel (MAIN) and the second liquid crystal display panel (SUB) are arranged such that the display region (AR) of the first liquid crystal display panel (MAIN) and the display region (AR) of the second liquid crystal display panel (SUB) face each other with the liquid crystal driver (DRV) therebetween.

The liquid crystal display module of this embodiment will be explained hereinafter by focusing on the point which makes this embodiment different from the above-mentioned embodiment 7.

In this embodiment, the first liquid crystal display panel (MAIN) and the second liquid crystal display panel (SUB) are connected with each other using a flexible printed circuit board (FPC3) such that the display region (AR) of the first liquid crystal display panel (MAIN) and the display region (AR) of the second liquid crystal display panel (SUB) are arranged to face each other with the liquid crystal driver (DRV) therebetween.

When the liquid crystal display module of this embodiment is mounted on a mobile phone, the liquid crystal display module is used in a folding manner along a broken line V.

In this embodiment, the video lines of the first liquid crystal display panel (MAIN) and the video lines of the second liquid crystal display panel (SUB) are respectively independently separated from each other, and, hence, the extra load is eliminated, whereby the power consumption can be reduced.

Further, since the first liquid crystal display panel (MAIN) and the second liquid crystal display panel (SUB) can be scanned arbitrarily (for example, simultaneously), the frame frequency can be optimized with respect to the first liquid crystal display panel (MAIN) and the second liquid crystal display panel (SUB), whereby the power consumption can be reduced.

Embodiment 9

Figure 29:
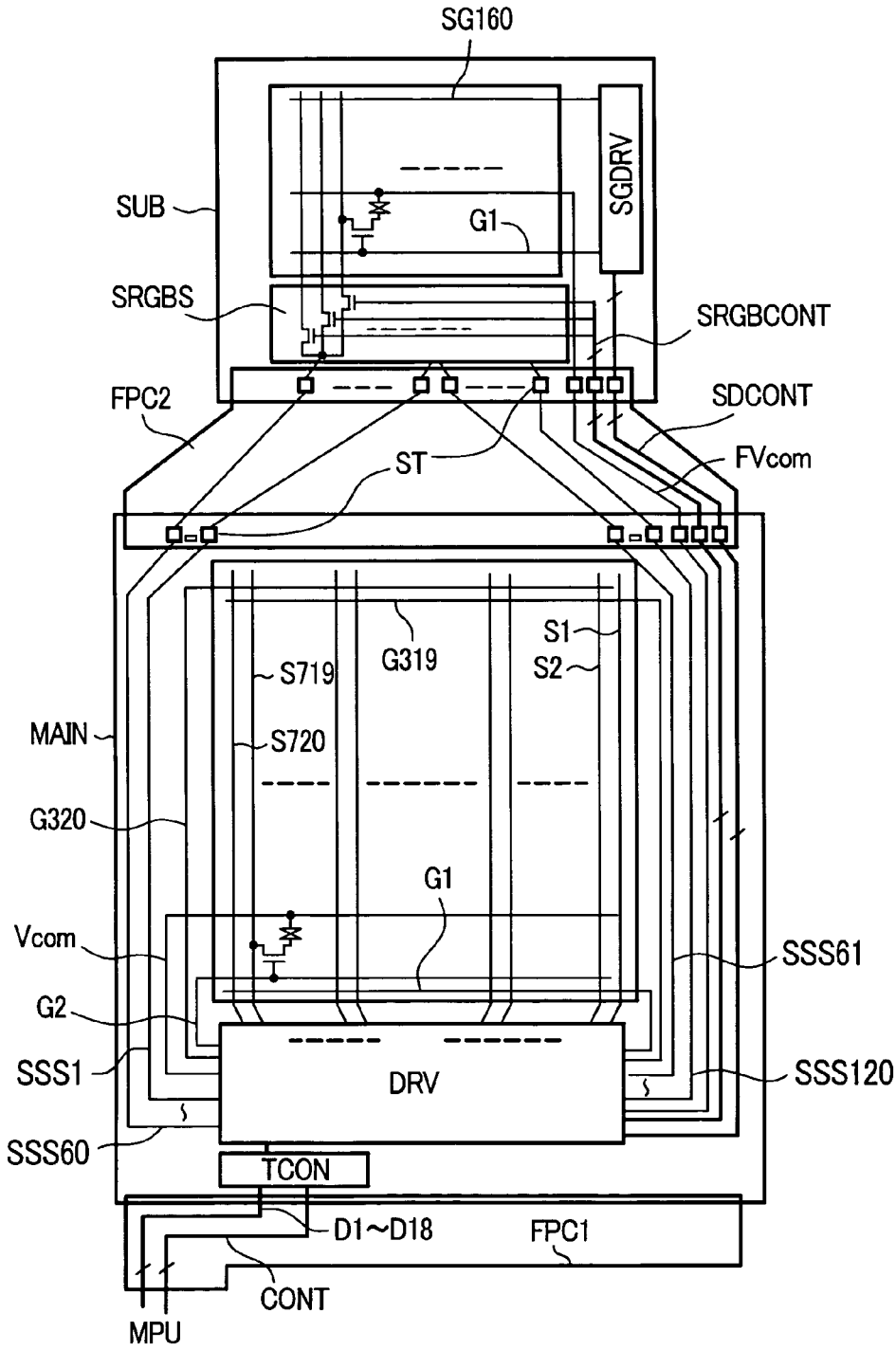
FIG. 29 is a block diagram showing the constitution of a liquid crystal display module representing an embodiment 9 of the present invention.

FIG. 29 is a diagram showing the constitution of a liquid crystal display module representing an embodiment 9 of the present invention.

The liquid crystal display module of this embodiment will be explained hereinafter by focusing on a point which makes this embodiment different from the above-mentioned embodiment 7.

The liquid crystal display module of this embodiment differs from the liquid crystal display module of the above-mentioned embodiment 7 with respect to the point that lines (SSS1 to SSS120) are formed on a glass substrate (glass substrate constituting a TFT substrate) of the first liquid crystal display panel (MAIN), and video voltages from the liquid crystal driver (DRV) are supplied to the video lines (SS1 to SS360) of the second liquid crystal display panel (SUB) through the lines (SSS1 to SSS120) and the connection lines of the flexible printed circuit board (FPC2).

Also, in this embodiment, the video lines of the first liquid crystal display panel (MAIN) and the video lines of the second liquid crystal display panel (SUB) are respectively independently separated from each other, and, hence, an extra load is eliminated, whereby the power consumption can be reduced.

Further, since the first liquid crystal display panel (MAIN) and the second liquid crystal display panel (SUB) can be scanned arbitrarily (for example, simultaneously), the frame frequency can be optimized with respect to the first liquid crystal display panel (MAIN) and the second liquid crystal display panel (SUB), whereby the power consumption can be reduced.

Embodiment 10

Figure 30:
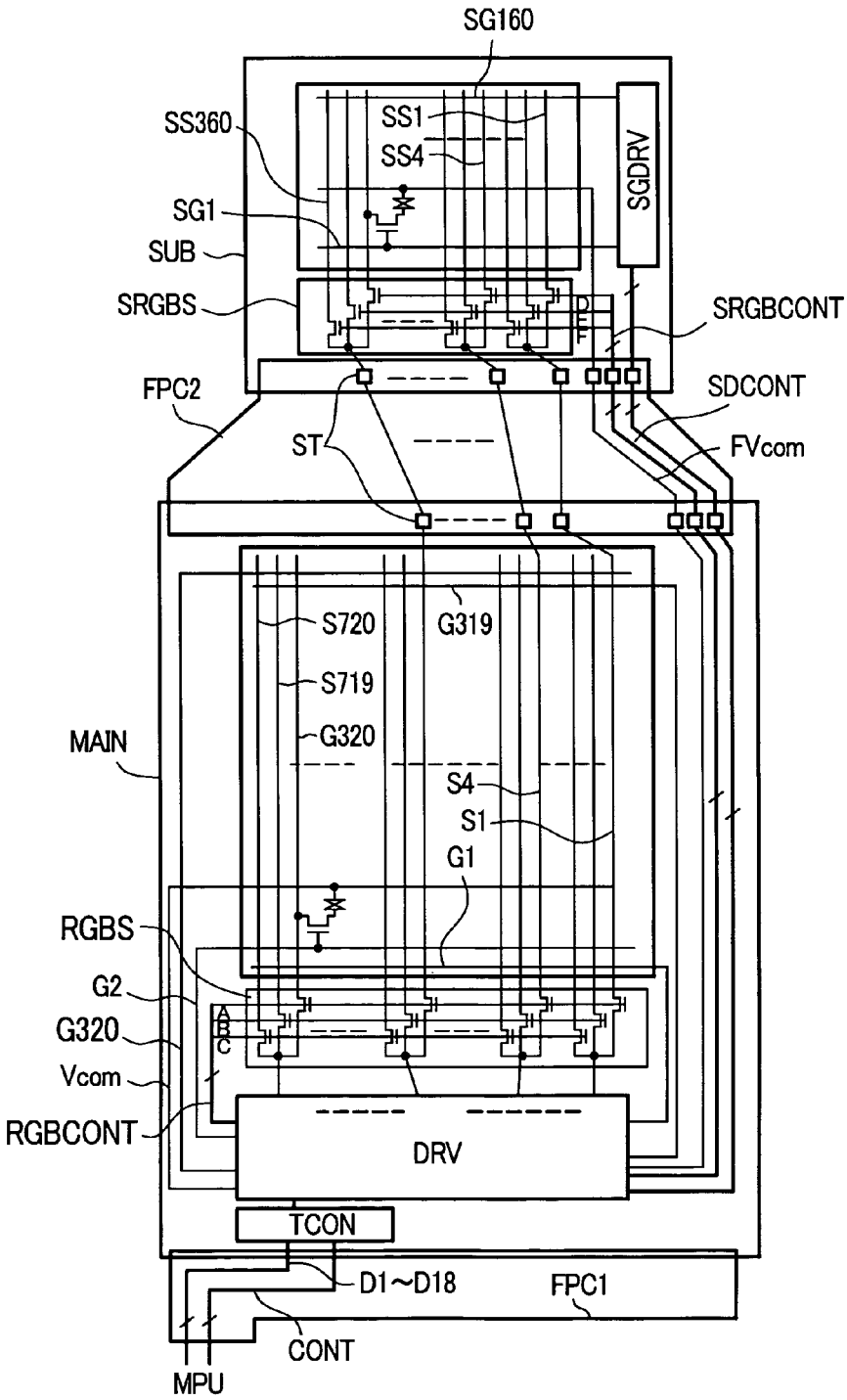
FIG. 30 is a block diagram showing the constitution of a liquid crystal display module representing an embodiment 10 of the present invention.

FIG. 30 is a diagram showing the constitution of a liquid crystal display module representing an embodiment 10 of the present invention.

The liquid crystal display module of this embodiment differs from the liquid crystal display module of the above-mentioned embodiment 7 with respect to the point that the video lines of the first liquid crystal display panel (MAIN) is divided into 240 sets, each of which is formed of three neighboring video lines of R (red), G (green), B (blue), and the video voltages are sequentially and in time-shared processing applied from the liquid crystal driver (DRV) to the video lines of R (red), G (green), B (blue) of respective sets.

The liquid crystal display module of this embodiment will be explained hereinafter by focusing on the point which makes this embodiment different from the above-mentioned embodiment 7.

In the liquid crystal display module of this embodiment, the video lines of the first liquid crystal display panel (MAIN) are divided into 240 sets, each of which is formed of three neighboring video lines of R (red), G (green), B (blue). Then, using an RGB selection circuit (RGBS), one of the video lines for R (red), G (green), B (blue) of the respective sets is selected sequentially and in time-shared processing, and the video voltages from the liquid crystal driver (DRV) are applied to the selected video line.

Further, to the video lines of the second liquid crystal display panel (SUB), the video voltage is supplied through one video line in each set (here, the video line which is selected in response to the signal A among the RGB selection circuit control signals (RGBCONT)).

Figure 31:
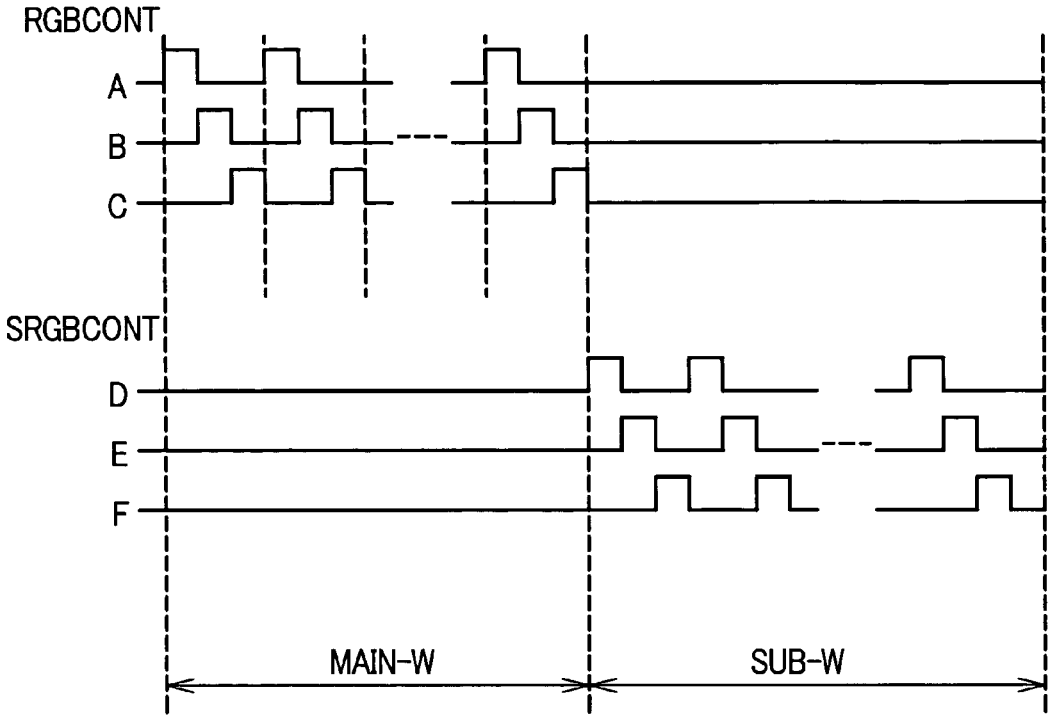
FIG. 31 is a timing chart illustrating operation of the RGB selection circuit shown in FIG. 30.

FIG. 31 is a timing chart illustrating the operation of the RGB selection circuit shown in FIG. 30.

As shown in FIG. 31, signals A, B, C of RGB selection circuit control signals (RGBCONT), which control the RGB selection circuit (RGBS), assume a High level or a Low level only during the writing period (MAIN-W) of the first liquid crystal display panel (MAIN) and turn off and on respective switching circuits of the RGB selection circuit (RGBS).

During the writing period (SUB-W) of the second liquid crystal display panel (SUB), the signal A is fixed to the High level so as to turn on the switching circuit.

During the writing period (SUB-W) of the second liquid crystal display panel (SUB), the signals B, C are fixed to the Low level so as to turn off the switching circuit.

Further, signals D, E, F of the RGB selection circuit control signals (SRGBCONT), which control the RGB selection circuit (SRGBS), assume a High level or a Low level only during the writing period (SUB-W) of the second liquid crystal display panel (SUB) and turn on and off the respective switching elements of the RGB selection circuit (SRGBS).

During the writing period (MAIN-W) of the first liquid crystal display panel (MAIN), the signals D, E, F are fixed to the Low level so as to turn off the switching circuit.

Accordingly, the capacity of the video lines of the second liquid crystal display panel (SUB) is not observed from the liquid crystal driver (DRV) at the time of writing of the first liquid crystal display panel (MAIN), and the capacity of two video lines of the first liquid crystal display panel (MAIN) is not observed from the liquid crystal driver (DRV) at the time of writing of the second liquid crystal display panel (SUB); and, hence, the load capacity can be made uniform (that is, the writing time can be made uniform), and, at the same time, the power consumption can be reduced.

Figure 32:
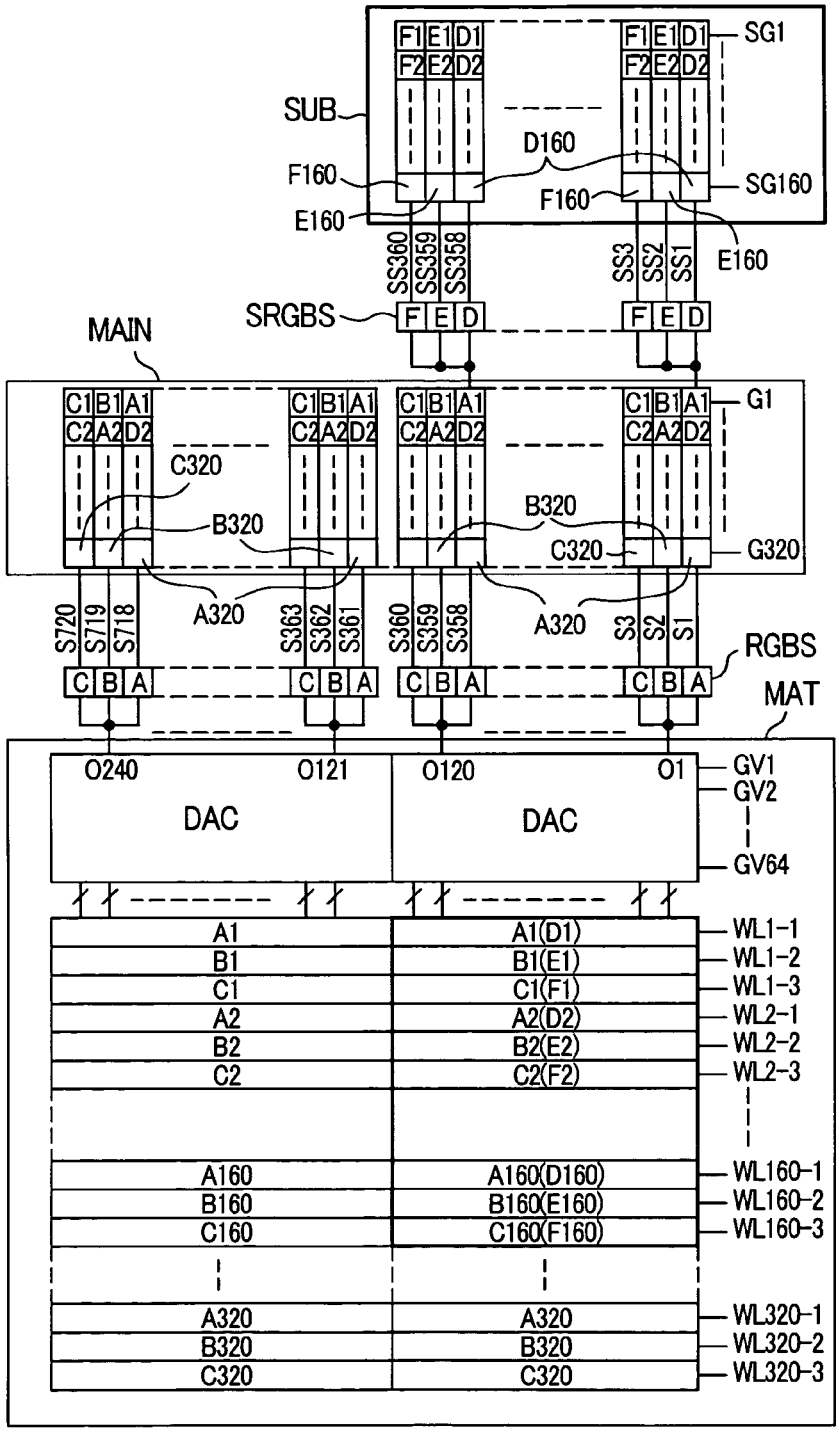
FIG. 32 is a diagram showing the correspondence between a memory mat (MAT) and sub pixels in a first liquid crystal display panel (MAIN) and a second liquid crystal display panel (SUB) in the embodiment 10 of the present invention.

FIG. 32 is a view showing the correspondence between the memory mat (MAT) and the sub pixels in the first liquid crystal display panel (MAIN) and the second liquid crystal display panel (SUB) in this embodiment of the present invention.

As in the case of this embodiment, even when both of the first liquid crystal display panel (MAIN) and the second liquid crystal display panel (SUB) are provided with the RGB selection circuit, to perform the time-shared driving of three video lines using three neighboring video lines as a set, since the display data A, B, C of the first liquid crystal display panel (MAIN) and the display data D, E, F of the second liquid crystal display panel (SUB) are present in a mixed form, a latch circuit (LTC) which latches the display data for three words and a multiplexer (MPX) are provided.

In the embodiment 3, due to the difference in the presence or non-presence of the selection circuit between the first liquid crystal display panel (MAIN) and the second liquid crystal display panel (SUB), the manner of storing the display data into the memory mat (MAT) differs. In this embodiment, the first liquid crystal display panel (MAIN) and the second liquid crystal display panel (SUB) adopt the same arrangement in the storing of the display data into the memory mat (MAT).

In FIG. 32, the right upper portion of the first liquid crystal display panel (MAIN), that is, a memory region which corresponds to (G1 to G160)×(S1 to S360) is used as the display data of the second liquid crystal display panel (SUB). However, the portion (G1 to G160)×(S1 to S360) of the first liquid crystal display panel (MAIN) and the portion (SG1 to SG160)×(SS1 to SS360) of the second liquid crystal display panel (SUB) adopt the same correspondence of the screen display with the arrangement of display data in the memory mat (MAT).

Here, in FIG. 32, the region which is used by the second liquid crystal display panel (SUB) in the memory mat is formed of the word line (WL1) to the word line (WL160). However, in the memory mat (MAT), the region used by the second liquid crystal display panel (SUB) may be set to any region. For example, the region may be formed of the word line (WL161) to the word line (WL320) or the word line (WL101) to the word line (WL260).

As an embodiment 11 of the present invention, a power source circuit in the inside of the liquid crystal driver (DRV) will be explained.

Figure 33:
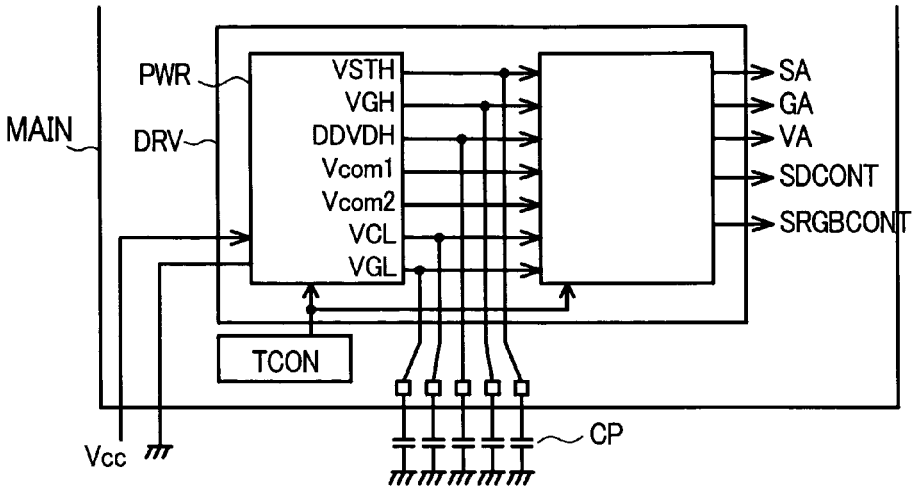
FIG. 33 is a block diagram showing the constitution of a power source circuit provided inside of a liquid crystal driver (DRV) in the respective embodiments of the present invention.

FIG. 33 is a diagram showing the constitution of the power source circuit in the inside of the liquid crystal driver (DRV) in the respective embodiments of the present invention. In FIG. 33, symbol PWR indicates a power source generating circuit and symbol CP indicates a power source stabilizing capacitor. Further, symbol SA indicates a voltage for driving the thin film transistors, symbol GA indicates a voltage for driving the gates of the thin film transistors, and symbol VA indicates a voltage applied to a common line.

Figure 34:
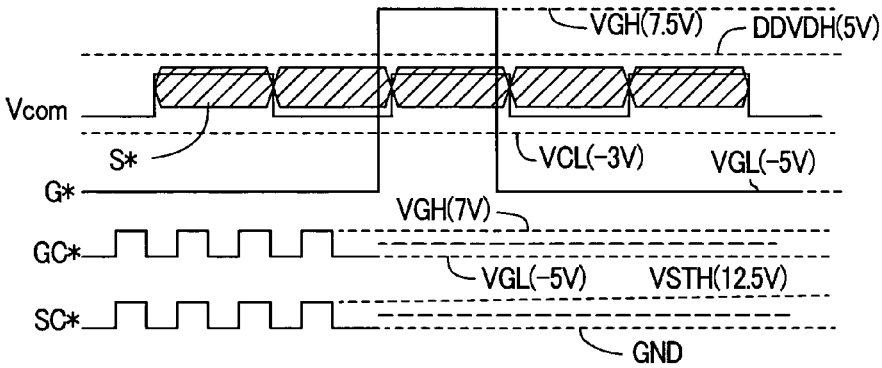
FIG. 34 is a diagram showing required voltages when a thin film transistor having a semiconductor layer made of polysilicon is used as a thin film transistor (STFT) which constitutes an active element of the second liquid crystal display panel (SUB)

FIG. 34 is a diagram showing required voltages when a thin film transistor having a semiconductor layer made of polysilicon is used as the thin film transistor (STFT), which constitutes an active element of the second liquid crystal display panel (SUB). Here, the drawing shows voltages employed when a common inversion method is adopted as a method for driving the liquid crystal display module.

In FIG. 34, symbol G* indicates the voltage applied to the gate electrode of the thin film transistor (STFT), S* indicates the video voltage, GC* indicates the control signal voltage applied to the sub scanning line drive circuit (SGDRV), and SC* indicates the control signal voltage supplied to the RGB selection circuit (SRGBS).

Figure 35:
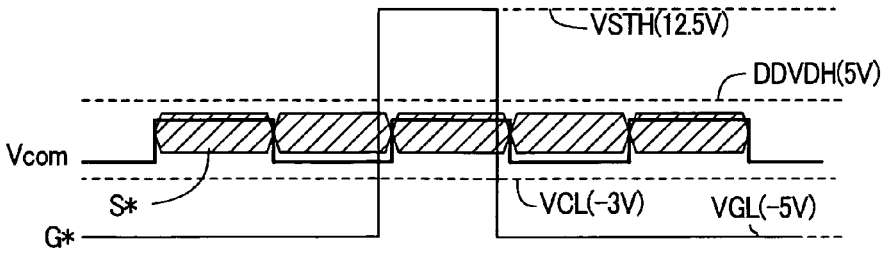
FIG. 35 is a diagram showing required voltages when a thin film transistor having a semiconductor layer made of amorphous silicon is used as a thin film transistor (TFT) which constitutes an active element of the first liquid crystal display panel (MAIN)

FIG. 35 is a diagram showing the required voltages when a thin film transistor having a semiconductor layer made of amorphous silicon is used as the thin film transistor (TFT), which constitutes an active element of the first liquid crystal display panel (MAIN). Here, the drawing shows the voltages employed when a common inversion method is adopted as a method for driving the liquid crystal display module.

In FIG. 35, symbol G* indicates the voltage applied to the gate electrode of the thin film transistor, S* indicates the video voltage, GC* indicates the control signal voltage applied to the sub scanning line drive circuit (SGDRV), and SC* indicates the control signal voltage supplied to the RGB selection circuit (SRGBS).

In the above-mentioned respective embodiments, the thin film transistors are formed of only a nMOS transistor, and, hence, the manufacturing cost can be reduced. Further, by using the power source in common, the circuit area can be reduced, and the number of the exteriorly mounting parts can be reduced, and, hence, the manufacturing cost can be reduced.

When only an nMOS transistor is used as the thin film transistor having a semiconductor layer made of polysilicon, as the High voltage of the control signal voltage (SC*) of the RGB selection circuit, a voltage (VSTH) higher than the gate control signal voltage becomes necessary, and, hence, one more power source becomes necessary compared to the case where a pair MOS transistor is used as such a thin film transistor.

However, when the thin film transistor with a semiconductor layer formed of amorphous silicon is employed in the first liquid crystal display panel (MAIN), the voltage VSTH is also used as the High voltage applied to the gate electrode.

Here, it is possible to improve the space efficiency by mounting the power source circuit on the glass substrate of the first liquid crystal display panel (MAIN).

Embodiment 12

Figure 36A:
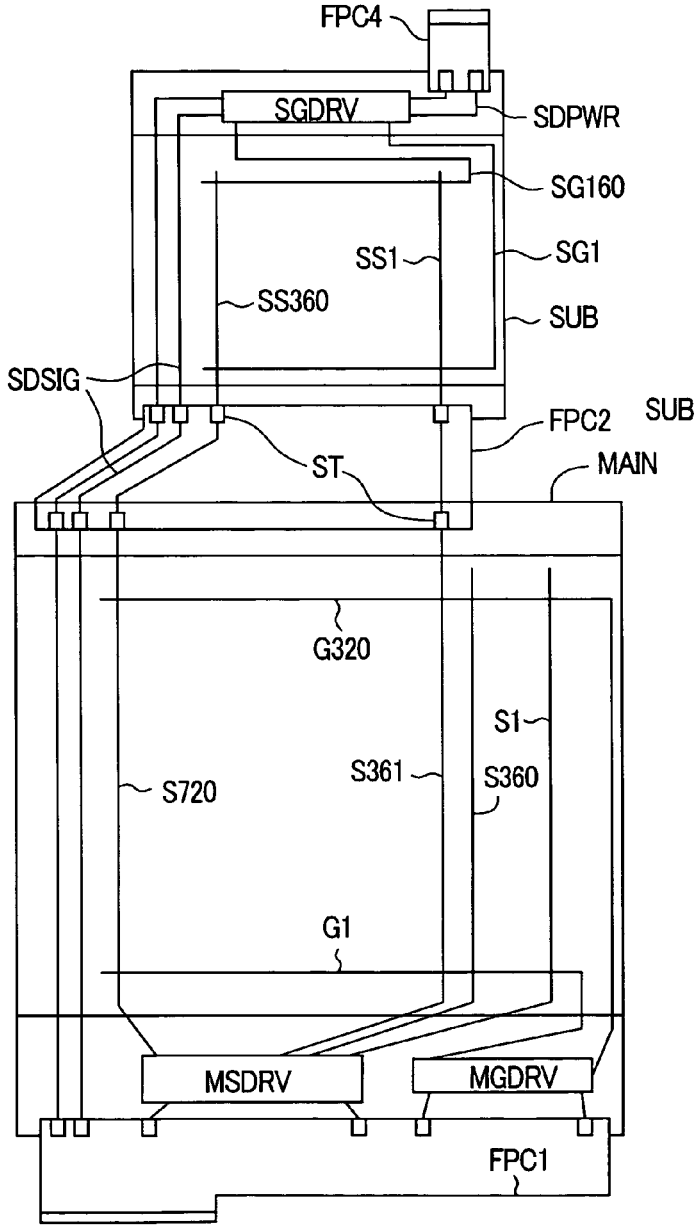
FIG. 36A is a diagram showing the constitution of a liquid crystal display module representing an embodiment 12 of the present invention.

FIG. 36A is a diagram showing the constitution of a liquid crystal display module representing an embodiment 12 of the present invention.

The liquid crystal display module of this embodiment differs from the liquid crystal display module of the above-mentioned embodiment 1 with respect to the point that there is provided a flexible printed circuit board for supplying the power source voltage to the sub scanning line drive circuit (SGDRV) of the second liquid crystal display panel (SUB).

The liquid crystal display module of this embodiment will be explained hereinafter by focusing on the point which makes this embodiment different from the above-mentioned embodiment 1.

In the above-mentioned respective embodiments, the sub scanning line drive circuit control signals (SDCONT) include the power source voltage and the control signals for the sub scanning line drive circuit (SGDRV). However, in this embodiment, the power source voltage (SDPWR) for the sub scanning line drive circuit (SGDRV) is supplied to the sub scanning line drive circuit (SGDRV) of the second liquid crystal display panel (SUB) through the flexible printed circuit board (FPC4) and the power source line. Accordingly, it is unnecessary to form the power source line on the glass substrate of the first liquid crystal display panel (MAIN), and, hence, the wiring resistance of the power source can be decreased.

The flexible printed circuit board (FPC4) is connected with the flexible printed circuit board (FPC1) at the first liquid crystal display panel (MAIN) side. The sub scanning line drive circuit control signals (SDCONT) are supplied to the sub scanning line drive circuit (SGDRV) from the flexible printed circuit board (FPC1) at the first liquid crystal display panel (MAIN) side through the lines formed on the glass substrate of the first liquid crystal display panel (MAIN).

A power source generating circuit which generates the power source voltage (SDPWR) for the sub scanning line drive circuit (SGDRV) and a circuit which generates the sub scanning line drive circuit control signals (SDCONT) are provided in the inside of the video line drive circuit (MSDRV) at the first liquid crystal display panel (MAIN) side.

In FIG. 36, symbol MGDRV indicates a scanning line drive circuit at the first liquid crystal display panel (MAIN) side.

In this embodiment, the sub scanning line drive circuit (SGDRV) of the second liquid crystal display panel (SUB) is provided to a side of the second liquid crystal display panel (SUB) opposite to the side to which the flexible printed circuit board (FPC2) is connected; the scanning lines (SG1 to SF160) are arranged on one of the left and right sides of the substrate of the second liquid crystal display panel (SUB); and lines for the sub scanning line drive circuit control signals (SDCONT) are arranged on the other of the left and right sides of the second liquid crystal display panel (SUB). Accordingly, it is possible to form the display region of the second liquid crystal display panel (SUB) at the center in the left and right direction of the substrate.

Figure 36B:
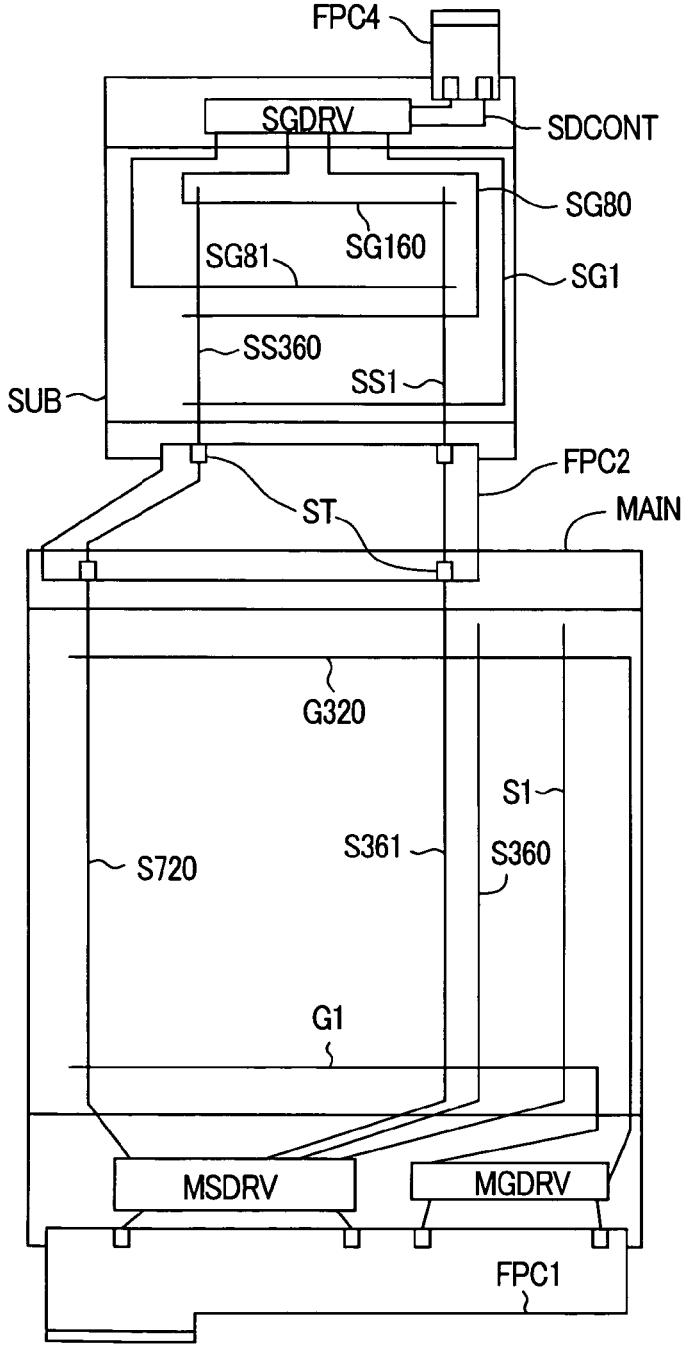
FIG. 36B is a diagram showing a modification of the liquid crystal display module of the embodiment 12 of the present invention.

FIG. 36B is a view showing a modification of this embodiment. The modification shown in FIG. 36B is configured such that the sub scanning line drive circuit control signals (SDCONT) are supplied to the sub scanning line drive circuit (SGDRV) of the second liquid crystal display panel (SUB) through the flexible printed circuit board (FPC4).

The sub scanning line drive circuit control signals (SDCONT) include the power source voltage (SDPWR) and the control signals for the sub scanning line drive circuit (SGDRV).

The flexible printed circuit board (FPC4) is connected to the flexible printed circuit board (FPC1) at the first liquid crystal display panel (MAIN) side.

Also, in this modification, the sub scanning line drive circuit (SGDRV) of the second liquid crystal display panel (SUB) is provided to a side of the second liquid crystal display panel (SUB) opposite to a side to which the flexible printed circuit board (FPC2) is connected, and the scanning signal lines are arranged in a dispersed manner with respect to both the left and right sides of the substrate. Accordingly, the display region (AR) of the second liquid crystal display panel (SUB) can be formed at the center in the left and right directions of the substrate.

Here, in this embodiment, although the video line drive circuit (MSDRV) and the scanning line drive circuit (MGDRV) of the first liquid crystal display panel (MAIN) are formed separately, in the same manner as in the above-mentioned embodiments, the video line drive circuit (MSDRV) and the scanning line drive circuit (MGDRV) of the first liquid crystal display panel (MAIN) may be integrally formed.

Due to such a constitution, it is also possible to arrange the scanning lines of the first liquid crystal display panel (MAIN) on the left and right sides of the display region (AR) of the first liquid crystal display panel (MAIN) in a dispersed manner, and, hence, it is possible to form the display region (AR) of the first liquid crystal display panel (MAIN) at the center in the left and right directions of the substrate.

Embodiment 13

Figure 37:
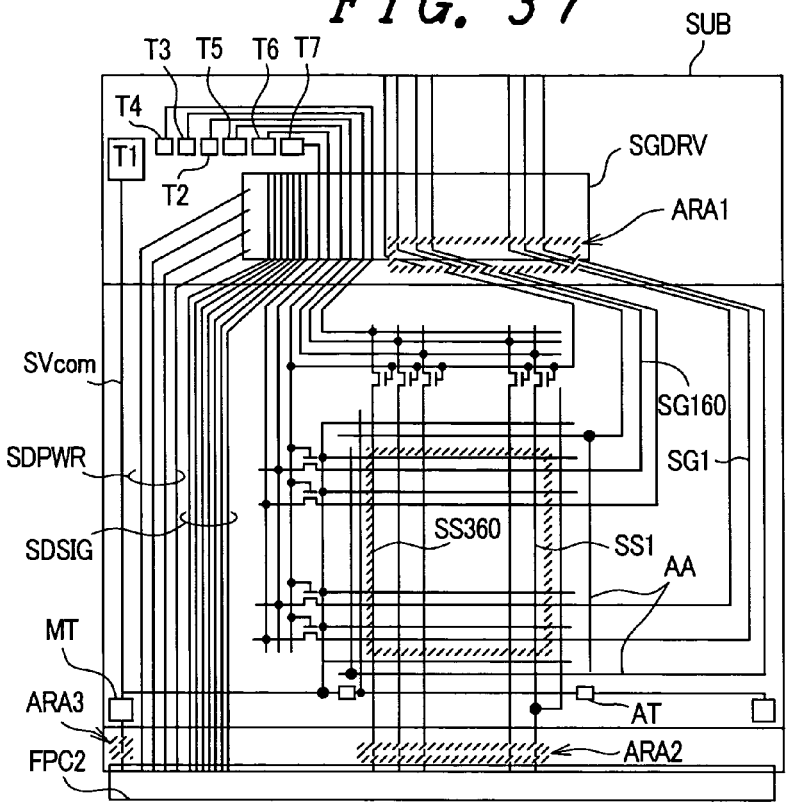
FIG. 37 is a diagram showing the constitution of a liquid crystal display module representing an embodiment 13 of the present invention.

FIG. 37 is a diagram showing the constitution of a liquid crystal display module representing an embodiment 13 of the present invention.

The liquid crystal display module of this embodiment differs from the liquid crystal display module of the above-mentioned embodiment 1 with respect to a point that inspection terminals are provided to the second liquid crystal display panel (SUB).

The liquid crystal display module of this embodiment will be explained hereinafter by focusing on the point which makes this embodiment different from the above-mentioned embodiment 1.

As shown in FIG. 37, on the glass substrate of the second liquid crystal display panel (SUB), there are an inspection signal input terminal (T7) for odd-numbered scanning lines, an inspection signal input terminal (T6) for even-numbered scanning lines, an inspection switching terminal (T5), an inspection signal input terminal (T2) for red video lines, an inspection signal input terminal (T3) for green video lines, an inspection signal input terminal (T4) for blue video lines, and an inspection signal input terminal (T1) for a common line of the second liquid crystal display panel (SUB).

To an inspection line which is connected to the inspection switching terminal (T5), a gate low power source line which supplies a gate low voltage to the sub scanning line drive circuit (SGDRV) is connected.

The inspection signal input terminal (T1) for a common line is connected to a common line (SVcom) of the second liquid crystal display panel (SUB), while remaining terminals are held in a floating state.

By always inputting the gate low voltage for turning off the thin film transistors to the inspection line which is connected to the inspection switching terminal (T5), the pixel and the inspection terminal and line are electrically separated from each other.

At the time of detecting the disconnection of respective video lines, a voltage of High level is applied to the inspection switching terminal (T5); the signals are inputted to the inspection signal input terminals (T2, T3, T4); and the inputted signals are detected at a video line inspection pad contact position (ARA2).

At the time of detecting the disconnection of respective scanning lines, a voltage of High level is applied to the inspection switching terminal (T5), the signals are inputted to the inspection signal input terminals (T6, T7), and the inputted signals are detected at a scanning line inspection pad contact position (ARA1).

At the time of detecting the disconnection of the common line, a voltage of High level is applied to the inspection switching terminal (T5); the signal is inputted to the inspection signal input terminal (T1); and the inputted signal is detected at a common line inspection pad contact position (ARA3).

In FIG. 37, the scanning lines are formed so as to extend to an end portion of the substrate to ensure the connection thereof with the common line in the periphery of the panel, thereby to prevent electrostatic breakdown at the time of manufacturing the panel.

By cutting the glass into a given size, the scanning lines and the common line are separated from each other.

Further, in FIG. 37, symbol AA indicates a common line for a protective diode, symbol AT indicates a two-way diode to connect the common line for the protective diode and a common terminal, and symbol MT indicates the common terminal.

Embodiment 14

Figure 38:
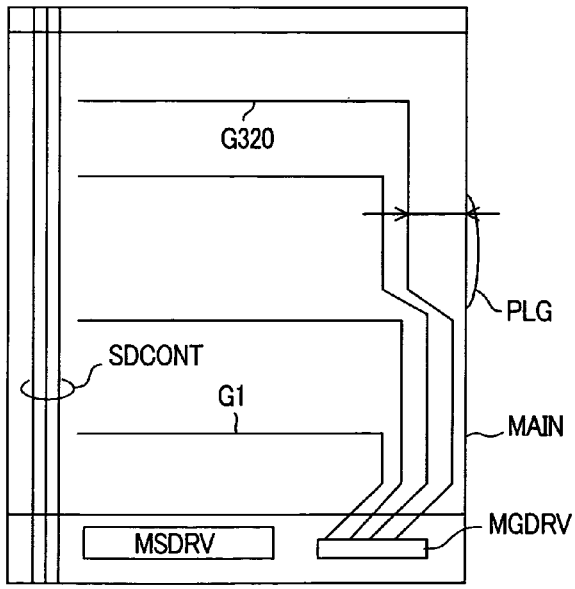
FIG. 38 is a diagram showing the constitution of a liquid crystal display module representing an embodiment 14 of the present invention.

FIG. 38 is a diagram showing the constitution of a liquid crystal display module representing an embodiment 14 of the present invention.

The liquid crystal display module of this embodiment is characterized by bending the scanning lines on the first liquid crystal display panel (MAIN) side in the above-mentioned embodiment 1.

The liquid crystal display module of this embodiment will be explained hereinafter by focusing on the point which makes this embodiment different from the above-mentioned embodiment 1.

In general, in the liquid crystal display panel, since it is necessary to form an optically curable sealing member (PLG) in a liquid crystal filling port, it is necessary to ensure a large distance from the substrate end to the scanning lines. Accordingly, in this embodiment, to arrange the scanning lines so as to avoid the region where the sealing member (PLG) is to be formed, the scanning lines are bent away from the end portion of the substrate. Since a sealing member (PLG) is also formed on the second liquid crystal display panel (SUB), the scanning lines at the second liquid crystal display panel (SUB) side are also configured to be bent.

In the above-mentioned respective embodiments, an explanation has been made with respect to the case in which the thin film transistor (TFT) of the first liquid crystal display panel (MAIN) and the thin film transistor (STFT) of the second liquid crystal display panel (SUB) are formed of a thin film transistor having a semiconductor layer made of amorphous silicon. However, at least one of the thin film transistor (TFT) of the first liquid crystal display panel (MAIN) and the thin film transistor (STFT) of the second liquid crystal display panel (SUB) may be formed of a thin film transistor having a semiconductor layer made of polysilicon.

When the thin film transistor having an semiconductor layer made of polysilicon is used as the thin film transistor (TFT) of the first liquid crystal display panel (MAIN), without using a semiconductor chip, the liquid crystal driver (DRV) and the thin film transistor having the semiconductor layer made of polysilicon are used as the TFT controller (TCON), and these parts are integrally formed with active elements (TFT) on the first liquid crystal display panel (MAIN).

In the same manner, when the thin film transistor having a semiconductor layer made of polysilicon is used as the thin film transistor (STFT) of the second liquid crystal display panel (SUB), without using a semiconductor chip, the thin film transistor having the semiconductor layer made of polysilicon is used as the sub scanning line drive circuit (SGDRV), and these parts may be integrally formed with active elements (TFT) on the second liquid crystal display panel (SUB).

Further, in the above-mentioned respective embodiments, an explanation has been made with respect to the integral-type liquid crystal display module which is provided with the first liquid crystal display panel (MAIN) and the second liquid crystal display panel (SUB), at least one of the first liquid crystal display panel (MAIN) and the second liquid crystal display panel (SUB) may be formed of an EL display panel which uses organic EL elements or inorganic EL elements.

Although the invention has been specifically explained based on the above-mentioned embodiments, it is needless to say that the present invention is not limited by the above-mentioned embodiments and various modifications are conceivable without departing from the gist of the present invention.

What is claimed is:

1. A display device comprising:

a first display panel comprising first scanning lines, first video lines, thin film transistors connected to the first scanning lines and the first video lines, and a first common voltage line;

a second display panel comprising second scanning lines, second video lines, thin film transistors connected to the second scanning lines and the second video lines, and a second common voltage line; and a first flexible printed circuit board connects the first display panel and the second display panel, wherein the first display panel comprises a liquid crystal driver connected to the second video lines via the first flexible printed circuit board and the first video lines, and connected to the second common voltage line via the first flexible printed circuit board and a connection line formed on the first display panel which is separate from the first common voltage line; and wherein the second display panel comprises a scanning line drive circuit connected to the second scanning lines, and controlled by the liquid crystal driver.

2. A display device according to claim 1, wherein the second video lines are connected to the liquid crystal driver via connection lines of the first flexible printed circuit board and the first video lines.

3. A display deice according to claim 1, wherein the second video lines are connected to the liquid crystal driver via connection lines of the first flexible printed circuit board and connection lines of the first display panel.

4. A display device according to claim 1, wherein the first display panel and the second display panel are arranged so that a display region of the first display panel and a display region of the second display panel face each other in an opposed manner while sandwiching the liquid crystal driver therebetween.

5. A display device according to claim 1, further comprising second flexible printed circuit board connected to a side of the first display panel which faces a side of the second display panel to which the first flexible printed circuit board is connected.

6. A display device according to claim 1, further comprising a second flexible printed circuit board connected to a side of the first display panel which faces a side of the second display panel to which the first flexible printed circuit board is connected, and power source voltages are supplied to the scanning line drive circuit of the second display panel via the second flexible printed circuit board.

7. A display device according to claim 1, wherein the scanning line drive circuit of the second display panel is arranged on a side of the second display panel which is adjacent to a side of the second display panel to which the first flexible printed circuit board is connected.

8. A display device according to claim 1, wherein at least one of the thin film transistors of the first display panel and the second display panel comprises semiconductor layers made of polysilicon.

9. A display device according to claim 8, wherein the scanning line drive circuit of the second display panel comprises thin film transistors having semiconductor layers made of polysilicon.

* * * * *